US008720988B1

(12) United States Patent
Underwood et al.

(10) Patent No.: US 8,720,988 B1
(45) Date of Patent: May 13, 2014

(54) PORTABLE CHAIR

(75) Inventors: Nathan A. Underwood, Roanoke, VA (US); Christine F. Underwood, Roanoke, VA (US)

(73) Assignee: Tomfoolery Designs, LLC, Roanoke, VA (US)

( * ) Notice: Subject to any disclaimer, the term of this patent is extended or adjusted under 35 U.S.C. 154(b) by 443 days.

(21) Appl. No.: 13/007,060

(22) Filed: Jan. 14, 2011

Related U.S. Application Data

(60) Provisional application No. 61/295,237, filed on Jan. 15, 2010.

(51) Int. Cl.
*A47D 1/02* (2006.01)

(52) U.S. Cl.
USPC ..... 297/16.2; 297/45; 248/435

(58) Field of Classification Search
USPC ..... 297/16.1, 16.2, 45, 344.18; 248/166, 248/434, 435
See application file for complete search history.

(56) References Cited

U.S. PATENT DOCUMENTS

| | | | | | |
|---|---|---|---|---|---|
| 402,709 | A * | 5/1889 | Abbott | 297/461 |
| 476,805 | A * | 6/1892 | Mason | 297/461 |
| 517,929 | A * | 4/1894 | March | 297/461 |
| 772,316 | A * | 10/1904 | Mock | 108/118 |
| 946,942 | A * | 1/1910 | Linger | 297/140 |
| 3,084,896 | A * | 4/1963 | Alexiou | 108/118 |
| 4,009,904 | A * | 3/1977 | Sheldon | 297/217.1 |
| 4,934,638 | A * | 6/1990 | Davis | 248/164 |
| 6,676,208 | B2 * | 1/2004 | Lu | 297/188.2 |
| 6,702,384 | B1 * | 3/2004 | Brown | 297/344.18 |
| 7,370,908 | B2 * | 5/2008 | Crowell | 297/16.2 |
| 7,588,228 | B2 * | 9/2009 | May | 248/436 |
| 8,272,684 | B2 * | 9/2012 | Obolewicz et al. | 297/16.2 |

* cited by examiner

*Primary Examiner* — Peter Brown
(74) *Attorney, Agent, or Firm* — Rhodes IP PLC; Christopher R Rhodes

(57) ABSTRACT

Certain embodiments described herein are directed to portable devices operative as high chairs. The devices are collapsible to facilitate easy set-up and take down and can be configured in many different manners. In certain embodiments, safety features may also be included in the devices.

15 Claims, 18 Drawing Sheets

PORTABLE CHAIR

PRIORITY APPLICATION

This application is a non-provisional application of, and claims priority to, U.S. Application No. 61/295,237 filed on Jan. 15, 2010, the entire disclosure of which is hereby incorporated herein by reference for all purposes.

TECHNOLOGICAL FIELD

This application is directed to portable devices. In particular, this application is directed to portable devices that are operative as high chairs, portable chairs or similar devices.

BACKGROUND

Many high chairs exist to facilitate feeding of a baby or toddler. The high chairs are generally fixed and non-portable, which results in a parent having to procure a high chair when dining at a restaurant.

SUMMARY

In a first aspect, a chair frame comprising first, second, third and fourth support members each comprising a seat end and a telescopic end, the telescopic end configured to alter the length of the support members is provided. In certain examples, the chair frame can include a hub coupled to the first support member through a first coupling, the hub coupled to the second support member through a second coupling, the hub coupled to the third support member through a third coupling, and the hub coupled to the fourth support member through a fourth coupling.

In certain embodiments, the telescopic end of the first support member comprises an inner sleeve and an outer sleeve, the inner sleeve configured to engage the outer sleeve to lock the inner sleeve and the outer sleeve. In other embodiments, the telescopic end of each of the first, second, third and fourth support members comprises an inner sleeve and an outer sleeve, the inner sleeve configured to engage the outer sleeve to lock the inner sleeve and the outer sleeve. In additional embodiments, the seat end of each of the first, second, third and fourth support members comprises a slot configured to engage and retain a seat. In some examples, at least one of the telescopic members comprises a wheel to facilitate movement of the chair frame. In other examples, the first, second, third and fourth couplings are each a rod. In additional examples, the first, second, third and fourth support members are each configured at an acute angle relative to a surface in which the telescopic end rests against. In further examples, the hub comprises a locking mechanism configured to prevent substantial movement of the first, second, third and fourth couplings. In other examples, the chair frame further comprises an additional hub coupled to the first support member through a fifth coupling, the additional hub coupled to the second support member through a sixth coupling, the additional hub coupled to the third support member through a seventh coupling, and the additional hub coupled to the fourth support member through an eighth coupling. In additional examples, the additional hub and the hub are arranged in a stacked configuration.

In another aspect, a chair comprising a seat, a first support member comprising a telescopic end and a seat end, the seat end comprising coupling means for engaging the seat to the seat end of the first support member, and the telescopic end comprising an inner sleeve and an outer sleeve, in which the inner sleeve is configured to engage the outer sleeve to lock the inner sleeve to the outer sleeve, the inner sleeve further comprising a release mechanism to release the inner sleeve from the outer sleeve, a hub coupled to the first support member through a first coupling, a second support member coupled to the hub through a second coupling, the second support member comprising a telescopic end and a seat end, the seat end comprising coupling means for engaging the seat to the seat end of the second support member, and the telescopic end comprising an inner sleeve and an outer sleeve, in which the inner sleeve is configured to engage the outer sleeve to lock the inner sleeve to the outer sleeve, the inner sleeve further comprising a release mechanism to release the inner sleeve from the outer sleeve, and a third support member coupled to the hub through a third coupling, the third support member comprising a telescopic end and a seat end, the seat end comprising coupling means for engaging the seat to the seat end of the third support member, and the telescopic end comprising an inner sleeve and an outer sleeve, in which the inner sleeve is configured to engage the outer sleeve to lock the inner sleeve to the outer sleeve, the inner sleeve further comprising a release mechanism to release the inner sleeve from the outer sleeve is described.

In some embodiments, the chair further comprises a fourth support member coupled to the hub through a fourth coupling, the fourth support member comprising a telescopic end and a seat end, the seat end comprising coupling means for engaging the seat to the seat end of the fourth support member, and the telescopic end comprising an inner sleeve and an outer sleeve, in which the inner sleeve is configured to engage the outer sleeve to lock the inner sleeve to the outer sleeve, the inner sleeve further comprising a release mechanisms to release the inner sleeve from the outer sleeve. In other embodiments, the seat is constructed and arranged for placement of a toddler in the chair. In additional embodiments, the seat is constructed and arranged for placement of a non-toddler in the chair. In further embodiment, the hub comprises a locking mechanism configured to prevent substantial movement of the first, second, third and fourth couplings. In some examples, the first, second, third and fourth couplings are each configured as a rod. In other examples, the first, second, third and fourth couplings are attached to their respective support member through a hinge. In additional examples, the chair further comprises a tray coupled to the chair frame. In some embodiments, the chair further comprises an additional hub coupled to the first support member through a fifth coupling, the additional hub coupled to the second support member through a sixth coupling, the additional hub coupled to the third support member through a seventh coupling, and the additional hub coupled to the fourth support member through an eighth coupling. In other embodiments, the additional hub and the hub are arranged in a stacked configuration.

In an additional aspect, a device comprising a seat, at least three independent telescopic legs coupled to the seat, and hub means coupled to each of the three telescopic legs, the hub means for locking the device into an open position and for unlocking the device to permit collapse of the legs to a closed position is disclosed.

In certain embodiments, the device further comprises a fourth independent telescopic leg coupled to the hub means. In other embodiments, the four telescopic legs and hub are integral. In some embodiments, the hub means comprises a locking groove configured to lock couplings between the telescopic legs and the hub means into place. In additional embodiments, the hub means is configured to receive a sleeve to lock couplings between the telescopic legs and the hub means into place. In some embodiments, the seat comprises a restraint and buckle mechanism. In some examples, the telescopic legs each comprise an inner telescopic sleeve and an outer sleeve. In additional examples, the hub means comprises a locking groove configured to lock couplings between the telescopic legs and the hub means into place. In other examples, the couplings are each hinged rods. In further examples, at least one of the couplings is a hinged rod.

In another aspect, a collapsed chair frame comprising first, second, third and fourth support members each comprising a seat end and a telescopic end, the telescopic end configured to alter the length of the support members, and a hub coupled to the first support member through a first coupling, the hub coupled to the second support member through a second coupling, the hub coupled to the third support member through a third coupling, and the hub coupled to the fourth support member through a fourth coupling, in which each of the first, second, third and fourth couplings is in a closed position to retain the first, second, third and fourth support members proximate are substantially the same distance from each other along their entire length is provided.

In an additional aspect, a collapsed chair comprising a seat, a first support member comprising a telescopic end and a seat end, the seat end comprising coupling means for engaging the seat and the telescopic end comprising an inner sleeve and an outer sleeve, in which the inner sleeve is configured to engage the outer sleeve to lock the inner sleeve to the outer sleeve, the inner sleeve further comprising a release mechanism to release the inner sleeve from the outer sleeve, a hub coupled to the first support member through a first coupling, in which the first coupling in a closed position, a second support member coupled to the hub through a second coupling, in which the second coupling is in a closed position, the second support member comprising a telescopic end and a seat end, the seat end comprising coupling means for engaging the seat and the telescopic end comprising an inner sleeve and an outer sleeve, in which the inner sleeve is configured to engage the outer sleeve to lock the inner sleeve to the outer sleeve, the inner sleeve further comprising a release mechanisms to release the inner sleeve from the outer sleeve, and a third support member coupled to the hub through a third coupling, in which the third coupling is in a closed position, the third support member comprising a telescopic end and a seat end, the seat end comprising coupling means for engaging the seat and the telescopic end comprising an inner sleeve and an outer sleeve, in which the inner sleeve is configured to engage the outer sleeve to lock the inner sleeve to the outer sleeve, the inner sleeve further comprising a release mechanisms to release the inner sleeve from the outer sleeve, in which the first support member, the second support member and the third support member are substantially the same distance from each other along their entire length is described.

In certain embodiments, the chair further comprises a fourth support member coupled to the hub through a fourth coupling, in which the fourth coupling is in a closed position, the fourth support member comprising a telescopic end and a seat end, the seat end comprising coupling means for engaging the seat and the telescopic end comprising an inner sleeve and an outer sleeve, in which the inner sleeve is configured to engage the outer sleeve to lock the inner sleeve to the outer sleeve, the inner sleeve further comprising a release mechanisms to release the inner sleeve from the outer sleeve, in which the first support member, the second support member, the third support member and the fourth support member are substantially the same distance from each other along their entire length.

In another aspect, a chair comprising a seat, a first support member comprising a telescopic end and a seat end, the seat end comprising coupling means for engaging the seat and the telescopic end comprising an inner sleeve and an outer sleeve, in which the inner sleeve comprises a locking mechanism configured to engage the outer sleeve to lock the inner sleeve to the outer sleeve and to release the inner sleeve from the outer sleeve, a first hub coupled to the first support member through a first coupling, the first coupling constructed and arranged with an open position and a closed position, a second support member coupled to the first hub through a second coupling, the second coupling constructed and arranged with an open position and a closed position, the second support member comprising a telescopic end and a seat end, the seat end comprising coupling means for engaging the seat and the telescopic end comprising an inner sleeve and an outer sleeve, in which the inner sleeve comprises a locking mechanism configured to engage the outer sleeve to lock the inner sleeve to the outer sleeve and to release the inner sleeve from the outer sleeve, a third support member coupled to the first hub through a third coupling, the third coupling constructed and arranged with an open position and a closed position, the third support member comprising a telescopic end and a seat end, the seat end comprising coupling means for engaging the seat and the telescopic end comprising an inner sleeve and an outer sleeve, in which the inner sleeve comprises a locking mechanism configured to engage the outer sleeve to lock the inner sleeve to the outer sleeve and to release the inner sleeve from the outer sleeve, a fourth support member coupled to the first hub through a fourth coupling, the fourth coupling constructed and arranged with an open position and a closed position, the fourth support member comprising a telescopic end and a seat end, the seat end comprising coupling means for engaging the seat and the telescopic end comprising an inner sleeve and an outer sleeve, in which the inner sleeve comprises a locking mechanism configured to engage the outer sleeve to lock the inner sleeve to the outer sleeve and to release the inner sleeve from the outer sleeve, and a second hub coupled to the first support member through a fifth coupling, the fifth coupling constructed and arranged with an open position and a closed position, the second hub coupled to the second support member through a sixth coupling, the sixth coupling constructed and arranged with an open position and a closed position, the second hub coupled to the third support member through a seventh coupling, the seventh coupling constructed and arranged with an open position and a closed position, and the second hub coupled to the fourth support member through an eighth coupling, the eighth coupling constructed and arranged with an open position and a closed position is disclosed.

In certain embodiments, the locking mechanism of each of the first, second, third and fourth support members is the same. In some embodiments, the locking mechanism of the first support member is different than the release mechanism of at least one of the second, third and fourth support members. In other embodiments, the coupling means of each of the first, second, third and fourth support members is the same. In additional embodiments, the coupling means of each of the first and second support members are the same, and the coupling means of the first and second support members are different than the coupling means of at least one of the third and fourth support members. In further embodiments, the coupling means of the first support member comprises a vertical slot comprising an open end and a closed end, the vertical slot sized and arranged to receive a groove on the seat to retain the seat in the vertical slot. In some examples, the coupling means of each of the first, second, third and fourth support members comprises a vertical slot comprising an open end and a closed end, the vertical slot sized and arranged to receive a groove on the seat to retain the seat in the vertical slot. In certain examples, the locking mechanism of the first support member comprises a pin on the inner sleeve that is configured to engage a hole on the outer sleeve to lock the inner sleeve to the outer sleeve when in an extended position and to release the inner sleeve from the outer sleeve when the pin is pressed. In other examples, the locking mechanism of each of the first, second, third and fourth support member comprises a pin on the inner sleeve that is configured to engage a hole on the outer sleeve to lock the inner sleeve to the outer sleeve when in an extended position and to release the inner sleeve from the outer sleeve when the pin is pressed. In some examples, the pin further comprises a slot configured to receive a locking device to prevent pressing of the pin.

In other aspects, a method of facilitating placement of a toddler or non-toddler by providing one or more of the chairs or chair frames described herein is provided.

In additional aspects, a method of feeding a toddler or non-toddler comprising selecting one or more of the chairs or chair frames provided herein is disclosed.

Additional features, aspect, examples and embodiments are described in more detail below.

BRIEF DESCRIPTION OF THE FIGURES

Certain embodiments are described with reference to the figures in which.

It will be recognized by the person of ordinary skill in the art, given the benefit of this disclosure, that certain dimensions or features in the figures may have been enlarged, distorted or shown in an otherwise unconventional or non-proportional manner to provide a more user friendly version of the figures. Where dimensions are specified in the description below, the dimensions are provided for illustrative purposes only.

DETAILED DESCRIPTION

Certain embodiments of the chairs described herein include independently telescopic legs to permit height adjustment of the chair. Other embodiments of the chairs include one or more hubs to assist in stability of the chair when open while still permitting the ability to close or collapse the chair quickly when desired. Certain other embodiments may include both of these features in addition to other features, as described in more detail below. In addition, while the seat is described below as being removable, in certain configurations the seat may be permanently fixed to the frame. In other embodiments, one or more components of the system, e.g., the hubs, may be removable, if desired, to further facilitate closing of the chair.

In certain examples, the chairs and components thereof described herein can provide for a safe, stable seating surface for babies, toddlers and non-toddlers while still providing rapid set-up and take down. In other embodiments, the chair can be sized and arranged to receive an adult, e.g., an elderly person or disabled person, to facilitate mobility of the adult or placement of the adult at a certain place or site for some time. The chair frames described herein can be configured as an integral chair frame, e.g., the parts of the chair frame cannot be removed or separated without damage to the chair frame, to avoid misplacement of the various parts.

Embodiments of the chair frame permit use of the chair in many different use environments including, but not limited to, a home setting, in restaurants, on vacation, in mobile vehicles such as, for example, recreational vehicles, buses, airplanes and the like. In some embodiments, the chair may include features such that it removably engages a surface, e.g., a table surface, whereas in other examples the chair may stand-alone without being stabilized by, or attached to, another surface or portion thereof.

In certain embodiments described herein, the chair frame may be referred to as in an "open" position or in a "closed" position. When open, the chair frame is open a suitable amount to permit interfacing of a seat that can be coupled to the chair frame. When closed, the seat still can be interfaced with the frame, or it may be removed, but the closed frame position is not suitable for placement of a user into the seat. In certain instances, the chair frame may be "collapsed" such that it is closed or folded to a position where the support members are brought proximate to each other.

Figure 1:
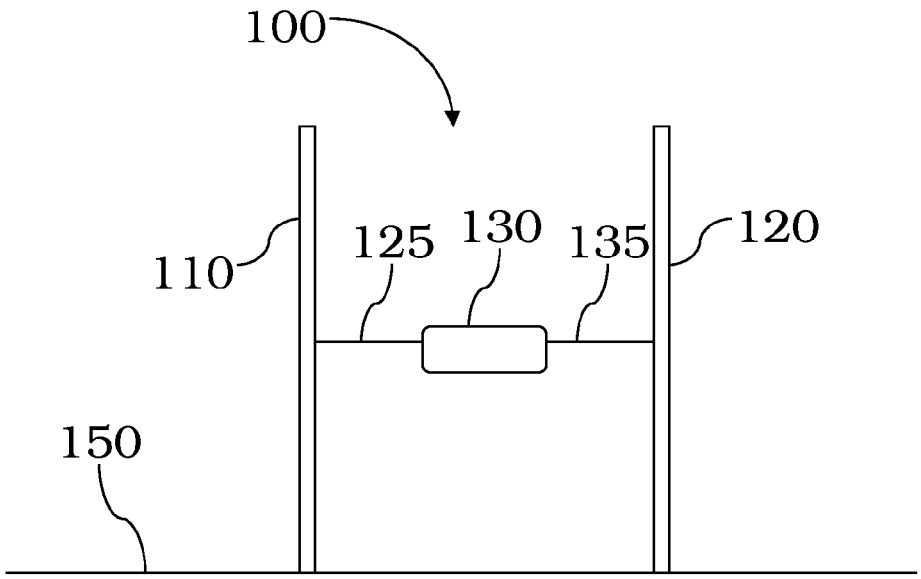
FIG. 1 is an illustration of a chair frame comprising a central hub, in accordance with certain examples.

In certain embodiments, the chair may include a frame and a seat. The exact design of the frame may vary and, in certain embodiments, the frame may include one or more hubs that are coupled to support members. A side view of a frame is shown in FIG. 1. The frame 100 comprises a first support member 110 and a second support member 120 each coupled to a hub 130 through couplings 125 and 135. The support members 110 and 120 may be identical or may be different. For example, the support members 110 and 120 may have one or more of the same cross-sectional shape, material composition, thickness, coloring, etc. or may have different physical features depending on the intended use of the chair. As described in more detail below, the support members 110 and 120 each can be constructed and arranged with a telescopic member whose overall length can be altered by an end-user. In certain embodiments, the support members 110 and 120 can be arranged orthogonal to a surface 150 which the device is positioned, e.g., a floor. For example, the support members 110, 120 can include an end that sits on the surface 150 to provide a stable seating platform. Each of the supports member 110 and 120 can engage the surface 150 in a suitable manner such that the chair 100 does not tip over or fall easily. In some examples, the support members can include safety features as an added measure in the event the chair is tipped or moved inadvertently.

Figure 2:
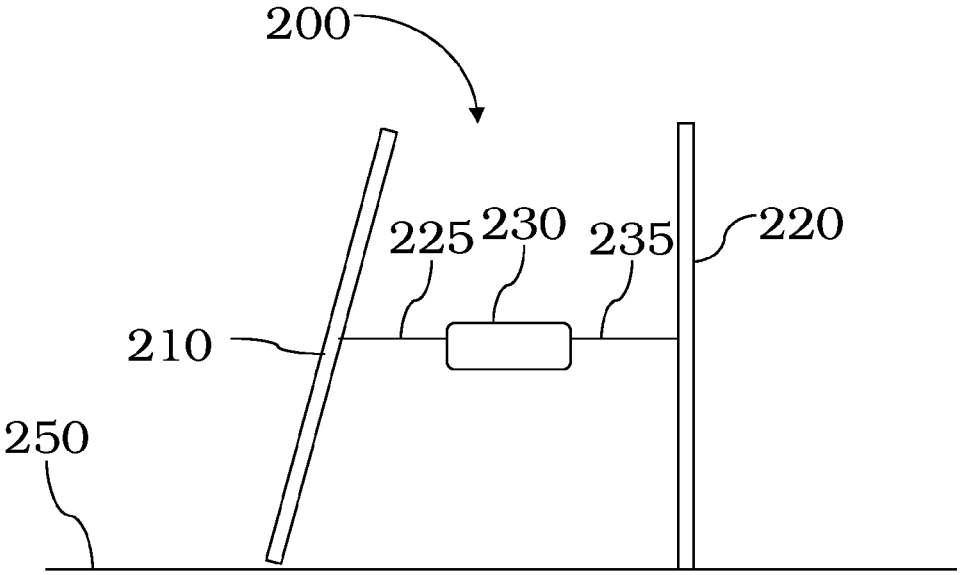
FIG. 2 is an illustration of a chair frame comprising a central hub where at least one of the support members is angled relative to a floor surface, in accordance with certain examples.

In other examples, the support members of the chairs described herein each can be angled, e.g., acutely angled or obtusely angled relative to the floor. It may be desirable to angle the support members acutely such that the chair can be placed closer to a table or other desired structure with a portion of the support member extending beneath the planar surface of the table. In some examples, one or more of the support members can be angled acutely. Referring to FIG. 2, a chair 200 includes a first support member 210, a second support member 220, a hub 230 and couplings 225 and 235. The hub 230 is coupled to the first support member 210 through the coupling 225 and the second support member 220 through the coupling 235. The longitudinal axis of the first support member 210 is angled acutely relative to a surface 250, whereas the longitudinal axis of the second support member 220 is angled orthogonally to the surface 250. In some examples, it may be desirable to adjust the angle of the support members such that they can be positioned at a suitable angle by the end user. For example, the coupling 225 may include suitable mechanisms to lock the first support member 210 at a desired angle, e.g., holes and pins or other mechanical mechanisms that can fix the support member at a desired angle for at least some period.

Figure 3:
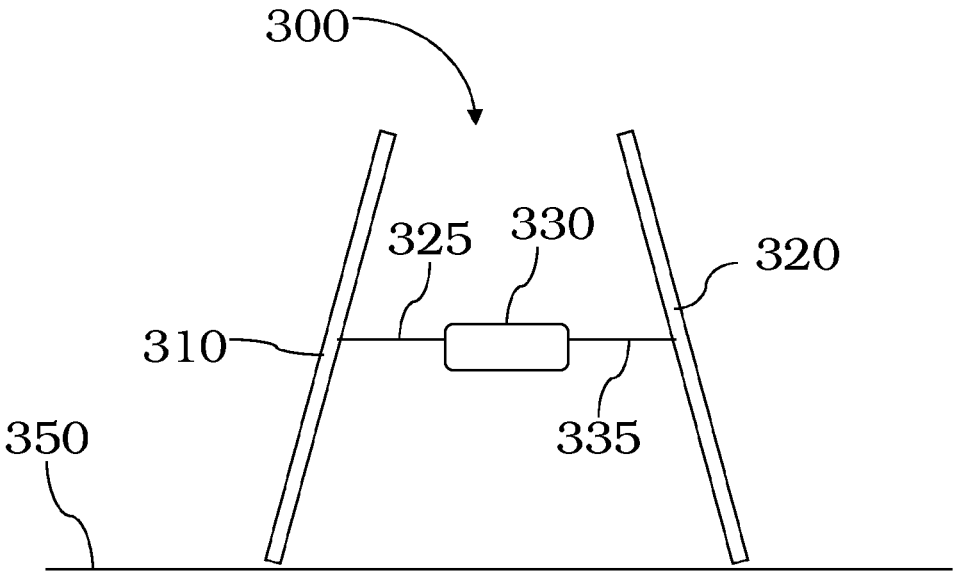
FIG. 3 is an illustration of a chair frame comprising a central hub where at least two of the support members are angled relative to a floor surface, in accordance with certain examples.

In certain embodiments, each of the support members can be independently angled acutely or obtusely. Referring to FIG. 3, a chair 300 includes a first support member 310, a second support member 320, a hub 330 and couplings 325 and 335. The hub 330 is coupled to the first support member 310 through the coupling 325 and the second support member 320 through the coupling 335. The longitudinal axis of the first support member 310 is angled acutely relative to a surface 350, and the longitudinal axis of the second support member 320 is also angled acutely relative to the surface 350. The exact degree of the acute angle can vary and in certain instances the angle can be manually altered or adjusted by the end user, e.g., by disengaging a locking mechanism, altering the angle of the support member and reengaging the locking mechanism. Illustrative angles include, but are not limited to, those angles less than or equal to ninety degrees. In addition, where the floor surface is slanted or non-flat, the height of each of the support members can be independently adjusted to offset any height non-uniformities.

Figure 4:
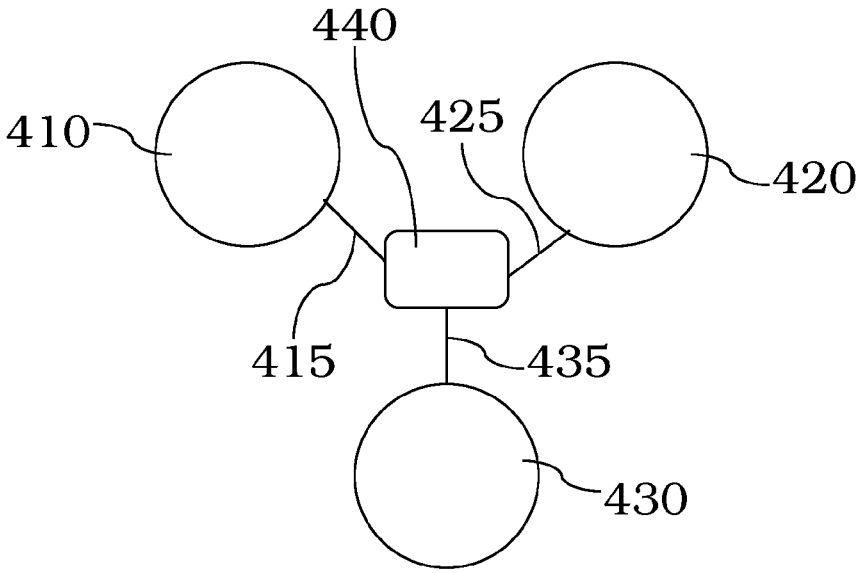
FIG. 4 is an illustration of chair frame comprising three support members, in accordance with certain examples.
Figure 5A:
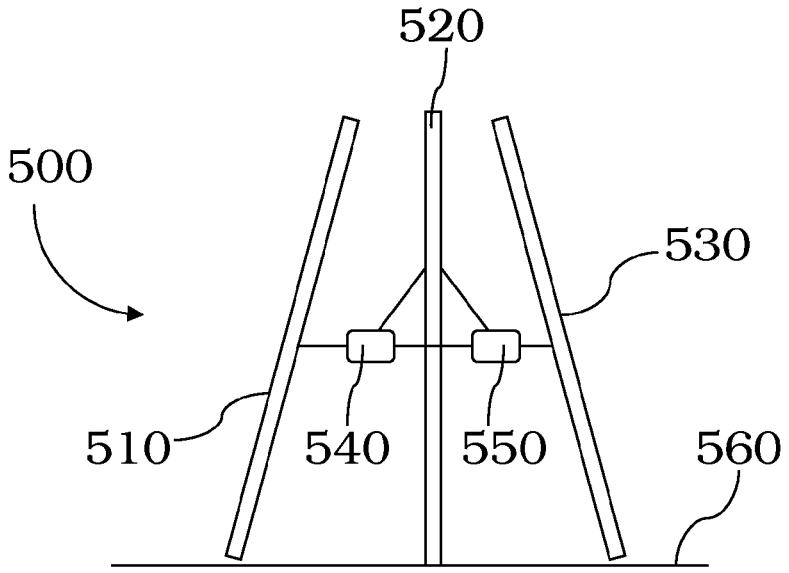
FIGS. 5A and 5B are illustrations of chair frame comprising three support members and showing the couplings between the hub and the support members, in accordance with certain examples.
Figure 5B:
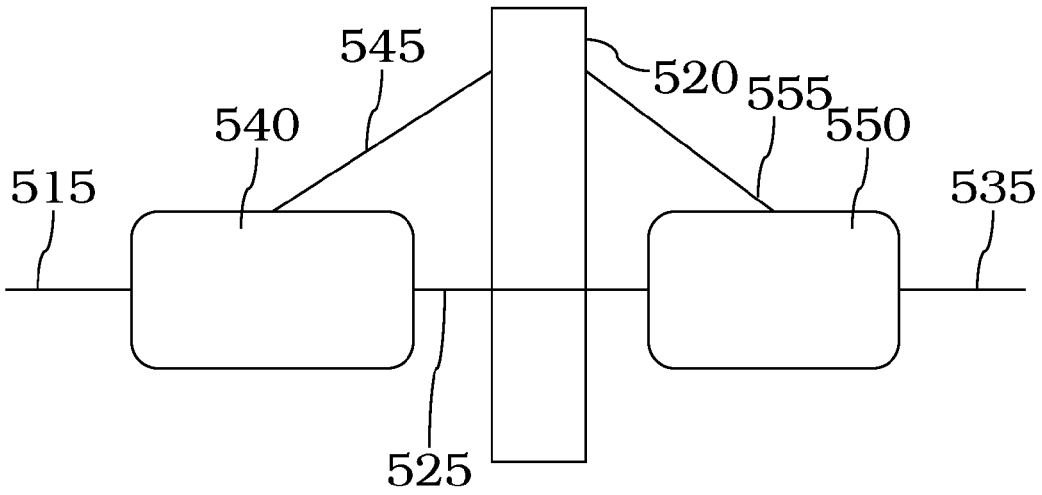

In certain embodiments, the exact number of support members present in the device can vary. In some embodiments, three, four, five, six or more support members can be present. Each of the support members may be coupled to one or more other support members to stabilize the frame when in an open position. Referring to FIG. 4, a frame 400 comprising three support members 410, 420 and 430 is shown. Each of the support members 410, 420 and 430 is coupled to a central hub 440 through couplings 415, 425 and 435 respectively. The particular site where the central hub 440 couples to each of the support members 415, 425 and 435 can vary and may be the same or different depending on the desired configuration. In addition, where three support members are present more than a single hub may be present. The additional hub may be coupled to another hub, to two or more support members or to other components of the frame. In some examples, the hubs are stacked such that one hub rest substantially above the other hub. Referring to FIGS. 5A and 5B, a perspective view of a frame that comprises two hubs is shown in FIG. 5A with the couplings from the hub to the support members shown enlarged in FIG. 5B. The frame 500 comprises support members 510, 520 and 530 that engage a surface 560. The first support member is coupled to a first hub 540 through a coupling 515. The first hub 540 is coupled to a second hub 550 through a coupling 525. The first hub is also coupled to the second support member 520 through a coupling 545. The second hub 550 is coupled to the second support member 520 through a coupling 555 and to a third support member 530 through a coupling 535.

Figure 6:
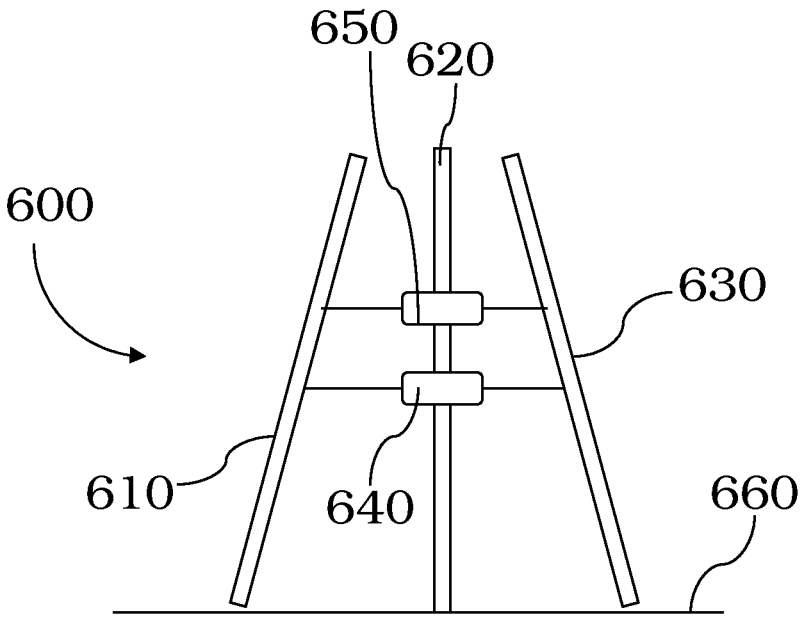
FIG. 6 is an illustration of a chair frame comprising two hubs, in accordance with certain examples.

In other configurations, two or more hubs can be present with each of the hubs coupled to each of the support members. One embodiment is shown in FIG. 6. The frame 600 includes three support members 610, 620 and 630 each independently coupled to hubs 640 and 650 through couplings between each support member and each hub. The hubs 640 and 650 are stacked on one another and may optionally be coupled to each other through another coupling (not shown).

Figure 7:
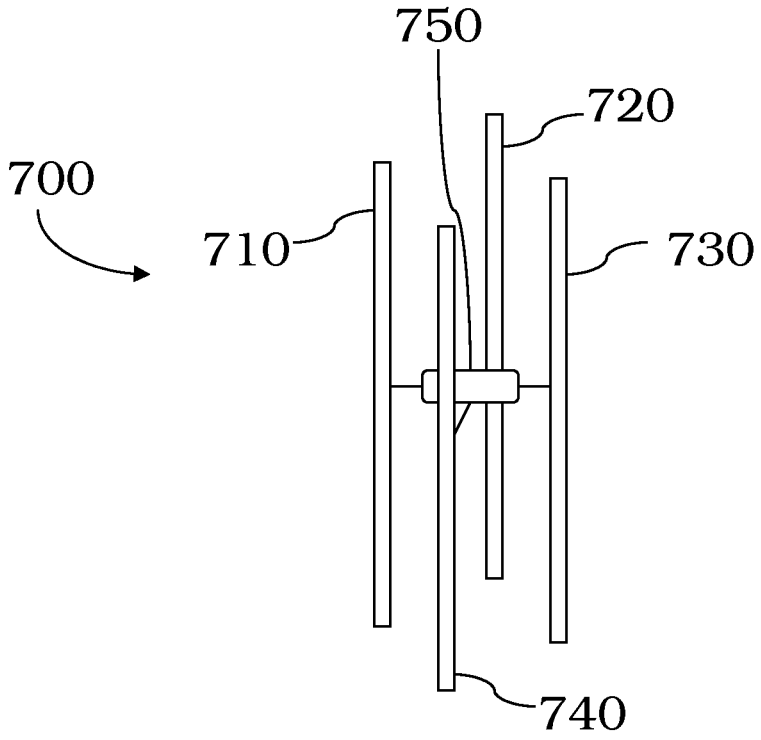
FIG. 7 is an illustration of a chair frame comprising four support members and a single hub, in accordance with certain examples.
Figure 8:
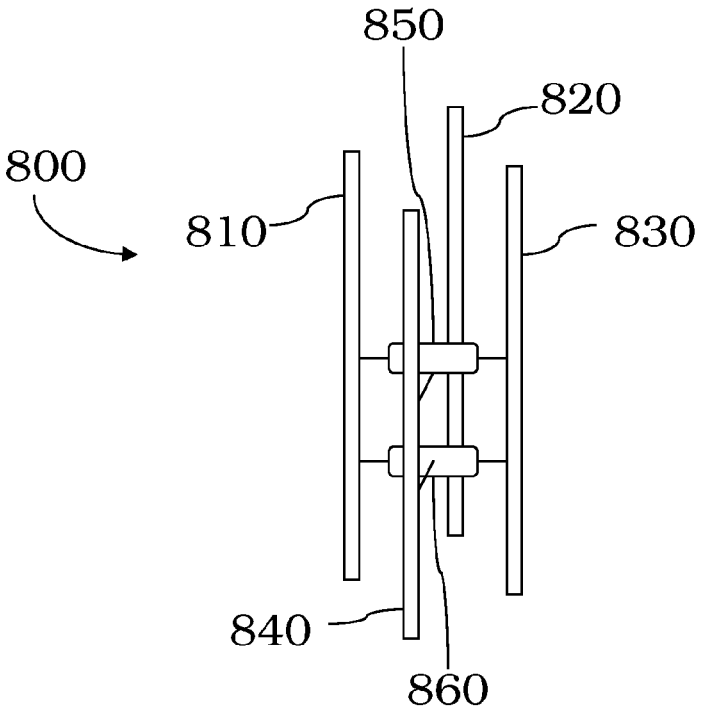
FIG. 8 is an illustration of a chair frame comprising four support members and two hubs, in accordance with certain examples.
Figure 9:
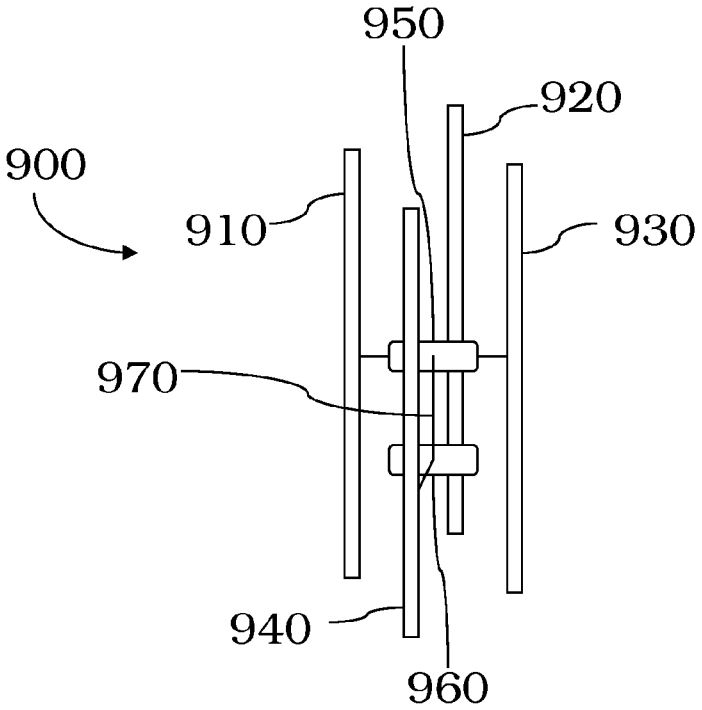
FIG. 9 is an illustration of a chair frame comprising four support members and two hubs comprising a hub-to-hub coupling, in accordance with certain examples.

In certain embodiments, the frame can include more than three support members including, for example, four support members, five support members, six support members or more. Several embodiments of frames including four support members are shown in FIGS. 7-9. Referring to FIG. 7, a frame 700 includes four support members 710, 720, 730 and 740 each coupled to a hub 750 through separate couplings. Referring to FIG. 8, a frame 800 includes four support member 810, 820, 830 and 840 each coupled to a first hub 850 and a second hub 860 through separate couplings. Referring to FIG. 9, a frame 900 includes four support member 910, 920, 930 and 940. The support members 910 and 930 are each coupled to a first hub 950 through separate couplings. The support members 920 and 940 are each coupled to a second hub 960 through separate couplings that are substantially perpendicular to the couplings between the support members 910 and 930 and the first hub 950. The first hub 950 and the second hub 960 are coupled to each other through a coupling 970. By coupling the first hub 950 and the second hub 960 through the coupling 970, twisting of the frame 900 can be reduced or eliminated.

Figure 10:
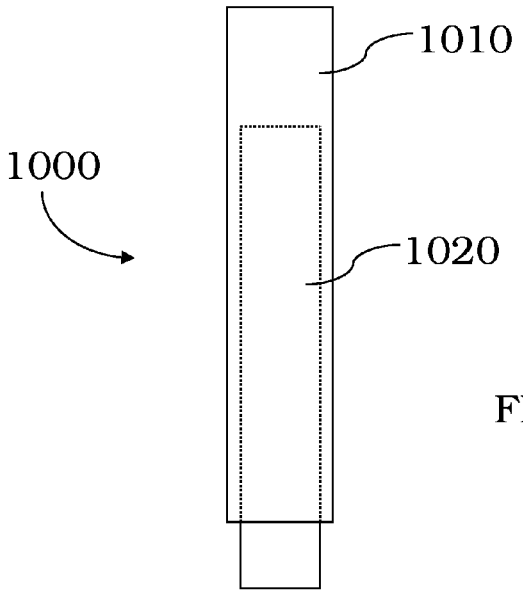
FIG. 10 is an illustration of a support member comprising an outer sleeve and an inner sleeve, in accordance with certain examples.

In certain examples, the exact configuration of each of the support members can vary. In some examples, a support member can be constructed and arranged with an inner sleeve and an outer sleeve as shown in FIG. 10. The support member 1000 comprises a an outer sleeve 1010 and an inner sleeve 1020 that is designed to be moved longitudinally within the outer sleeve 1010 to alter the overall length of the support member 1000. In certain embodiments, the support member may be referred to as "unitary" in that it comprises a single piece composed of the inner sleeve and outer sleeve. Such unitary support members provide advantages, e.g., simpler transport, no parts to lose or misplace, etc., over other designs that require mating of two or more different physical components to stabilize a chair or provide a desired height.

Figure 11A:
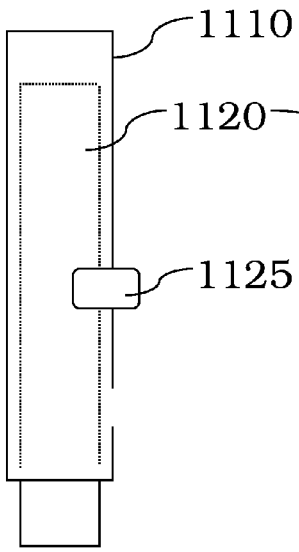
FIGS. 11A-11C are illustrations of an embodiment showing adjustment of the length of the support member, in accordance with certain examples.
Figure 11B:
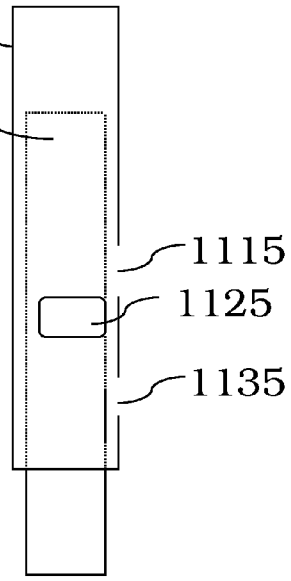
Figure 11C:
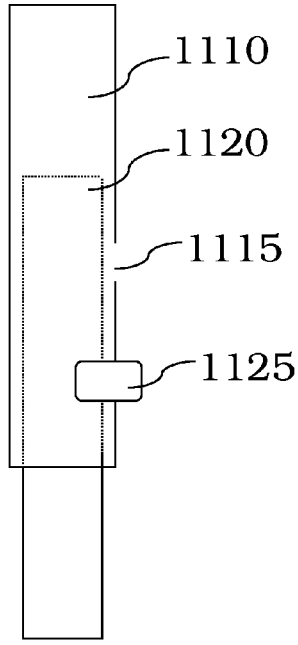

In certain embodiments, the inner sleeve may comprise a locking mechanism that can engage a portion of the outer sleeve to prevent movement of the inner sleeve when locked and permit movement of the inner sleeve when unlocked. One embodiment is shown schematically in FIGS. 11A-11C. The inner sleeve 1120 comprises a pin, button or boss 1125 that is spring loaded or otherwise biased outward perpendicularly from the longitudinal axis of the inner sleeve 1120. The pin 1125 engages a first locking hole 1115 of the outer sleeve 1110. Engagement of the locking hole 1115 by the pin 1125 locks the inner sleeve into place and fixes the overall length of the support member. The pin 1125 can be pressed as the inner sleeve 1120 is extended (FIG. 11B) such that the overall length of the support member increases. Once the inner sleeve 1120 is extended a certain amount, the pint 1125 automatically engages a second hole 1135 and locks the inner sleeve 1120 into a new position (FIG. 11C) and increases the overall length of the support member by exposing an increased length of the inner sleeve 1120.

Figure 12A:
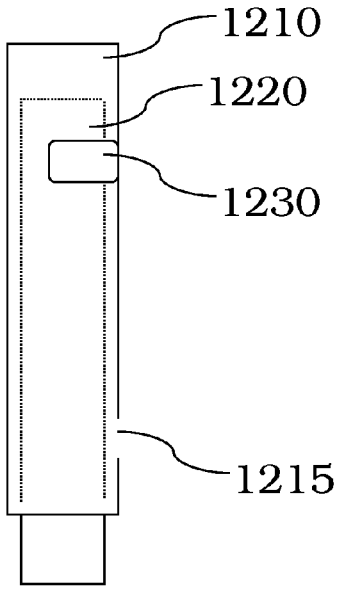
FIGS. 12A and 12B are illustrations of another embodiment showing adjustment of the length of the support member, in accordance with certain examples.
Figure 12B:
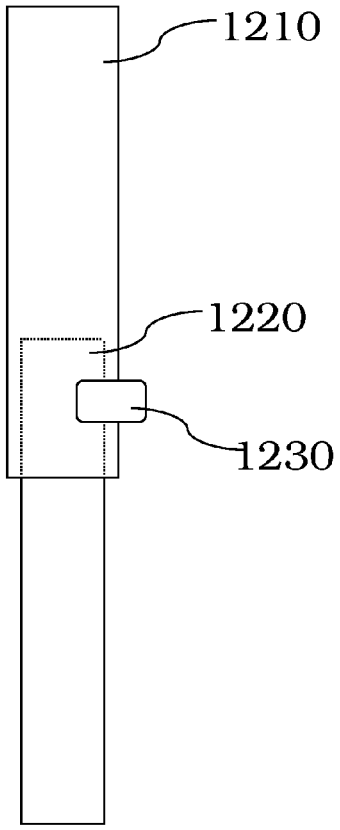
Figure 13A:
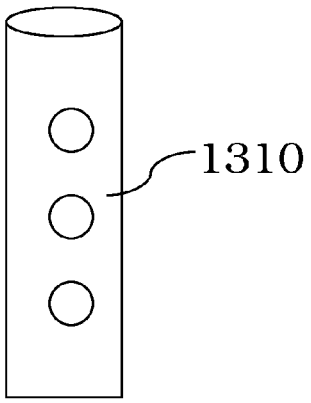
FIGS. 13A-13D are illustration of support members comprising a plurality of locking holes, in accordance with certain examples.
Figure 13B:
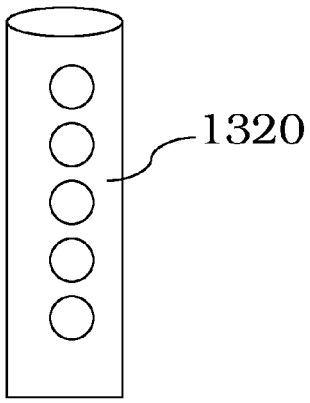
Figure 13C:
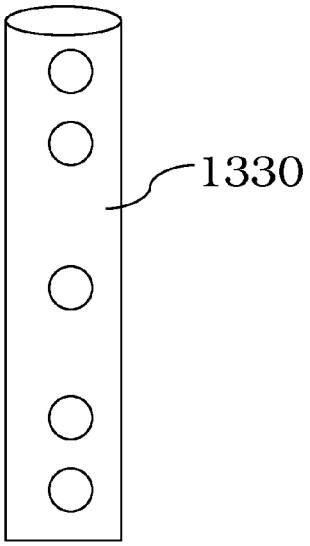
Figure 13D:
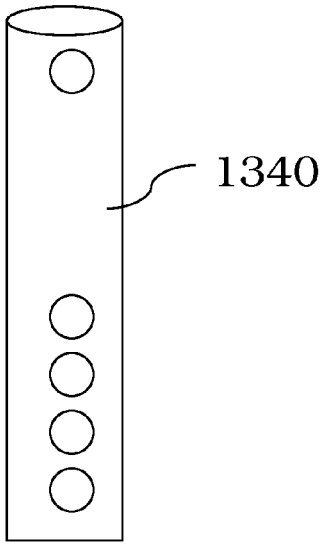

In certain examples, the exact number of holes in the outer sleeve can vary from a single hole to a plurality of holes, e.g., about one to about ten. For example, a single hole can be present as shown in FIGS. 12A and 12B such that only a single extended position is permissible. It may be desirable to provide a single extended position, for example, such that the seat of the chair will be at a height suitable for use with a standard dining table, e.g., 28-30 inches above a floor. By including only a single position, the chair can be opened and taken down rapidly. Referring to FIGS. 12A and 12B, the inner sleeve 1220 can be extended from a first position (FIG. 12A) to a second position (FIG. 12B) where the pin 1230 engages a locking hole 1215 in an outer sleeve 1210. In this manner, the support member can be extended to only a single length.

In other examples, the outer sleeve can include a plurality of holes as shown in FIGS. 13A-13D. The exact number of holes and their position along the outer sleeve can vary, and in certain examples, the holes are positioned about 1 inch, 1.5 inches, 2 inches, 2.5 inches, 3 inches, 3.5 inches, 4 inches, 4.5 inches, 5 inches or more apart from each other. In certain embodiments, the hole spacing may be equal, such as the hole spacing in support members 1310 and 1320, whereas in other embodiments, the hole spacing can vary along the length of the outer sleeve, such as the hole spacing shown on support member 1330 in FIG. 13C. For example, there can be an increased number of holes at the end of the outer sleeve opposite the seat end to provide for fine tuning of the overall support member height, as shown in the support member 1340 in FIG. 13D.

Figure 14:
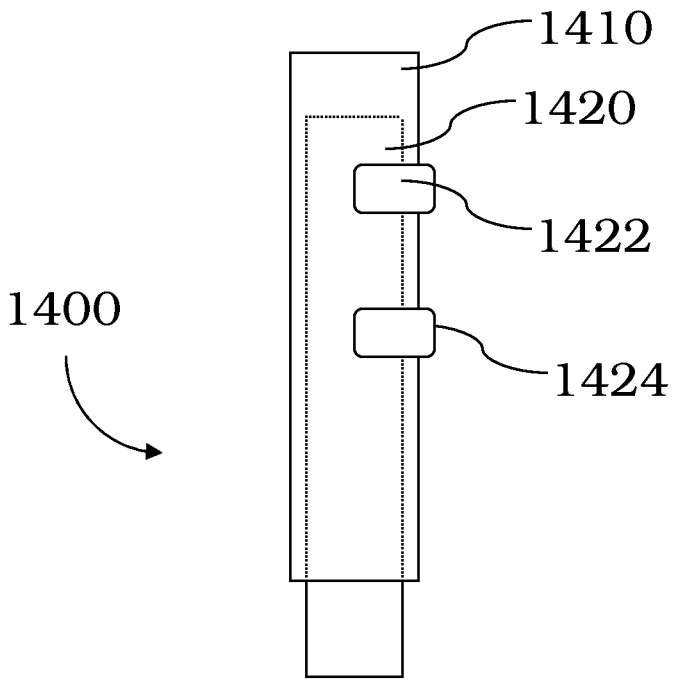
FIG. 14 is an illustration of a support member comprising at least two spring pins, in accordance with certain examples.

In addition to having a plurality of holes in the outer sleeve, the support member can also include more than a single pin that can be present on the inner sleeve to provide an added measure that the inner sleeve is locked in place to prevent collapse of the support member during operation. One example is shown in FIG. 14, where a support member 1400 is shown as including an outer sleeve 1410, an inner sleeve 1420 that comprises a first pin 1422 and a second pin 1424 each of which engages a separate hole in the outer sleeve 1410.

Figure 15A:
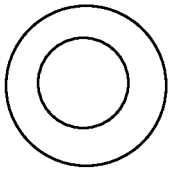
FIGS. 15A-15D are illustrations showing exemplary cross-sectional shapes for support members, in accordance with certain examples.
Figure 15B:
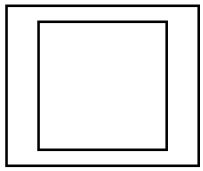
Figure 15C:
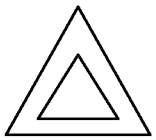
Figure 15D:
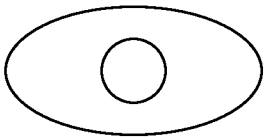

In certain examples, the cross-sectional shape of the support members can vary. For example and referring to FIGS. 15A-15D, the inner and outer sleeves can each be circular (FIG. 15A), square (FIG. 15B), triangular (FIG. 15C), elliptical (FIG. 15D) or other geometrical shapes as shown in the bottom views illustrated in FIGS. 15A-15D. In addition, the cross-sectional shape of the inner sleeve need not be the same as the cross-sectional shape of the outer sleeve (see FIG. 15D) so long as the inner sleeve can engage the outer sleeve, to at least some degree, to prevent the inner sleeve from sliding undesirably during use of the chair. Also, the x- and y-dimensions of the support members need not be the same and may be different at different areas along the support member. For example, it may be desirable to include a support member having an outer sleeve with a greater wall thickness at the seat end and less wall thickness at the foot end.

Figures 16A, 16B:
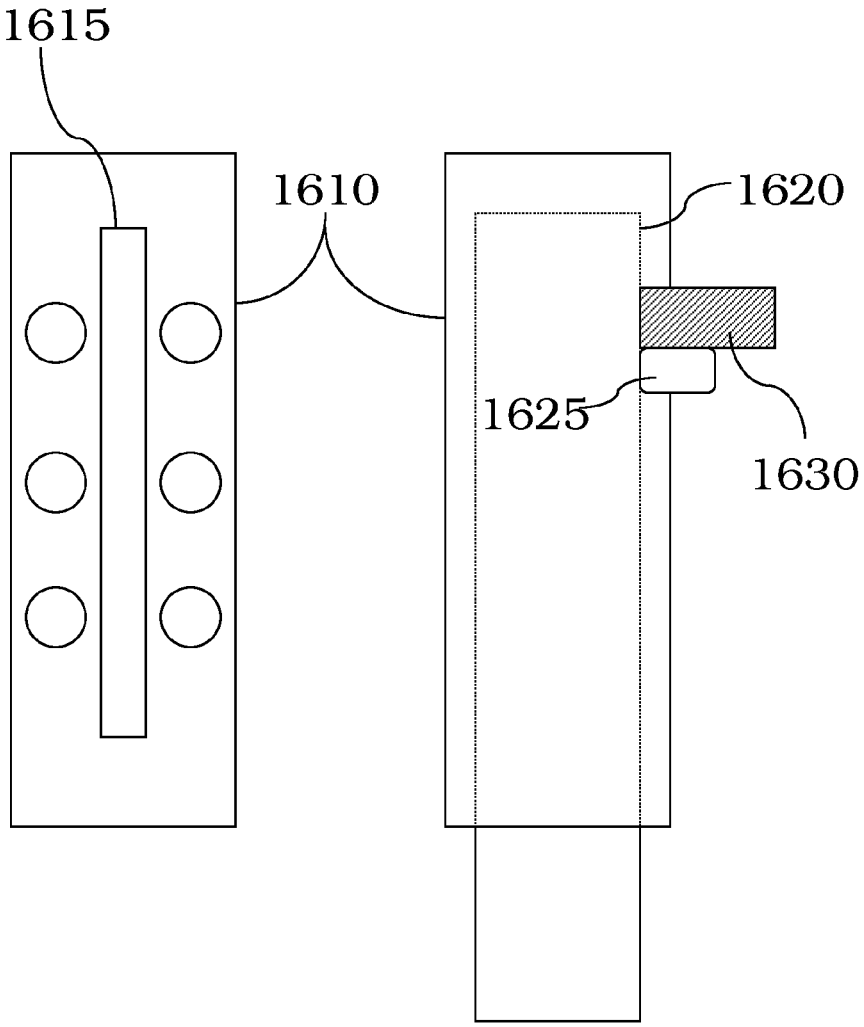
FIGS. 16A and 16B are illustrations of another embodiment showing locking of a support member into place, in accordance with certain examples.

In certain examples, the support member may be configured with an outer sleeve and an inner sleeve with the outer sleeve comprising a longitudinal groove disposed therein. The longitudinal groove may receive a pin fixed to the inner sleeve such that the pin can move vertically within the longitudinal groove of the outer sleeve. To stop movement of the pin within the longitudinal groove, the outer sleeve can include holes configured to engage a locking mechanism. One example is shown in FIGS. 16A and 16B. An outer sleeve 1610 comprises a longitudinal groove 1615 and a plurality of holes arranged adjacent to the longitudinal groove 1615. An inner sleeve 1620 comprises a protrusion 1625 that protrudes in, and slides along, the longitudinal groove 1615. To position the inner sleeve 1620 at a desired site within the outer sleeve 1610, a locking member 1630 can be inserted into holes above the position of the protrusion 1625 such that the length of the telescopic inner sleeve 1620 will not shorten. Gravitational forces can assist in keeping the length of the support member substantially constant, and, when a user sits in a seat coupled to the frame, the downward force exerted from sitting in combination with an inserted locking member keeps the inner sleeve extended and maintains the overall length of the support member. In some examples, a second locking member can be inserted into holes above the protrusion 1625 to deter movement upward or downward of the inner sleeve. The use of two locking members can be, for example, desirable where the chair in its use position is moved from one place to another.

In some embodiments, the telescopic end of the support member may include stabilizing features such as feet, tripods or the like. For example, the terminus of the telescopic end of the support member that contacts the floor may include generally planar feet to increase the overall surface area of the floor contacted by the chair. In some examples, the feet may be attached to the telescopic end of the support member using hinges or pins to permit movement of the feet. In other examples, the feet may be integral and unitary with the telescopic portion of the support member. The feet may include high friction surfaces or materials to deter sliding of the feet on the surface. In some examples, the telescopic end can include stabilizing arms that can fold out and engage the floor surface to provide additional stability to the chair when in use. The exact configuration of the feet can vary and the feet may have many different cross-sectional shapes including rectangular, circular, triangular or the like. The feet may be coupled to the inner sleeve in a manner than prevents the inner sleeve from being completely inserted into the outer sleeve when the frame is in a closed position. For example, the feet can be coupled to the terminus of the inner sleeve using a ball joint or a ball and socket joint that permits free movement of the feet while prohibiting full insertion of the inner sleeve into the outer sleeve.

In certain examples, the terminal end of the outer sleeve may include one or more features to prevent complete removal of the inner sleeve from the outer sleeve. For example, the outer sleeve can include an internal annulus or ring of smaller diameter than a diameter of a concentric ring of the inner sleeve such that full extension of the inner sleeve results in engagement of the inner ring of the outer sleeve with the concentric ring of the inner sleeve. Such engagement prohibits removal of the inner sleeve from the outer sleeve, which could result in misplacement of the inner sleeve during storage. Additional features to retain the inner sleeve within the outer sleeve will be readily selected by the person of ordinary skill in the art, given the benefit of this disclosure.

In certain embodiments, the support members of the chairs described herein can be produced from suitable materials including, but not limited to, metals, plastics, composites, alloys and the like. For example, the support members can be produced from stainless steel, aluminum, titanium or alloys thereof to facilitate clean up, increase overall load strength, reduce the likelihood of bacterial growth and to provide an overall pleasing aesthetic appearance. In other examples, the support members can be produced from a plastic such as, for example, a polyethylene, a polypropylene, a polycarbonate or a polyurethane, copolymers thereof and combinations thereof. Illustrative plastics include, but are not limited to ultra high molecular weight polyethylenes and rigid polyurethanes. The plastic can include a dye or colorant to impart a desired color to the support member. In addition, the plastic can be radiotransparent to facilitate transport of the chair onto aircraft or into other secure areas that may require X-rays or the like to enter. The plastic may also include additives or coatings to deter degradation upon exposure, for example, to sunlight or to varying temperatures. Where plastics having less than desired strength are used, the plastics can be reinforced with fibers, whiskers, fillers, metal particles or other materials that can increase the load strength of the support member.

In certain embodiments, the hub or hubs of the frames described herein can be present in many different configurations. In some examples, the hub is a fixed body that lies substantially central within the support members. In other examples, the hub may comprise one or more locking features that prevent substantial movement of the couplings between the hub and the support members when the chair is in use. In additional examples, the hub can be actuated between positions to prevent folding of the chair or allow folding of the chair. These and other hub configurations are described in more detail herein.

Figure 17A:
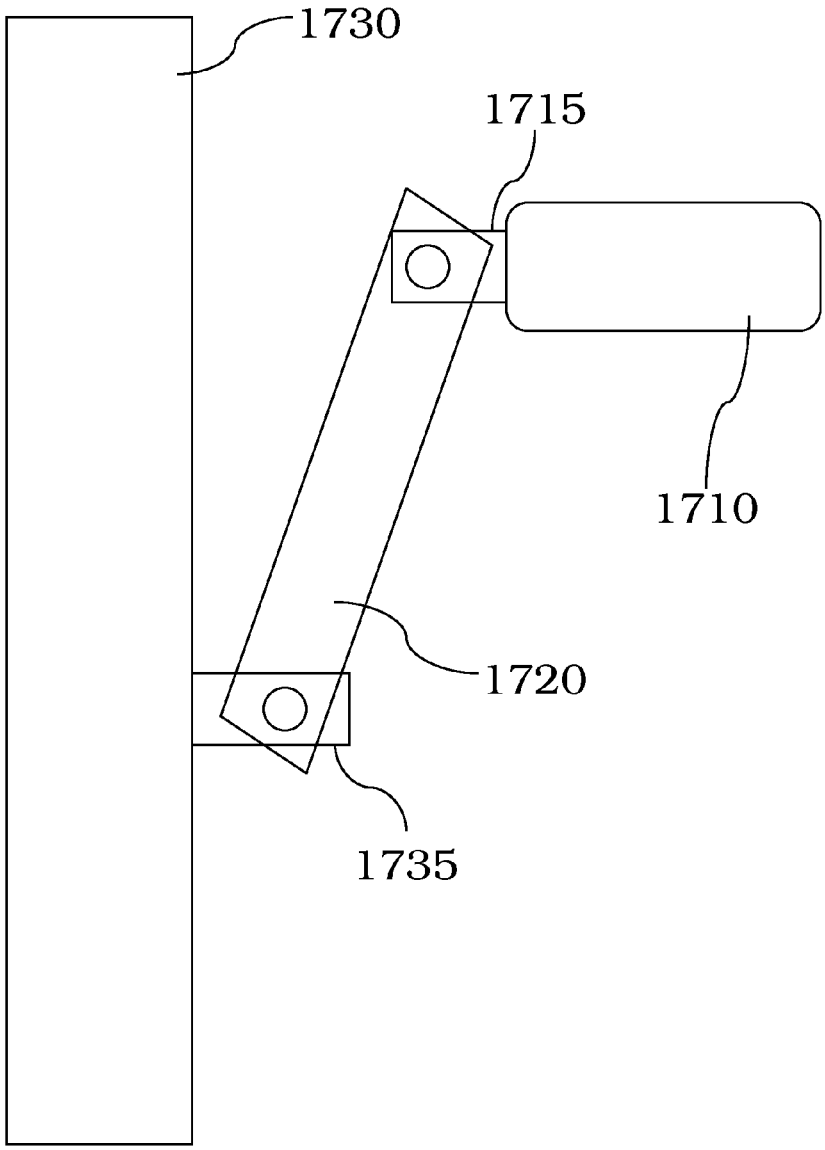
FIGS. 17A and 17B are illustrations showing locking of a hub into place, in accordance with certain examples.
Figure 17B:
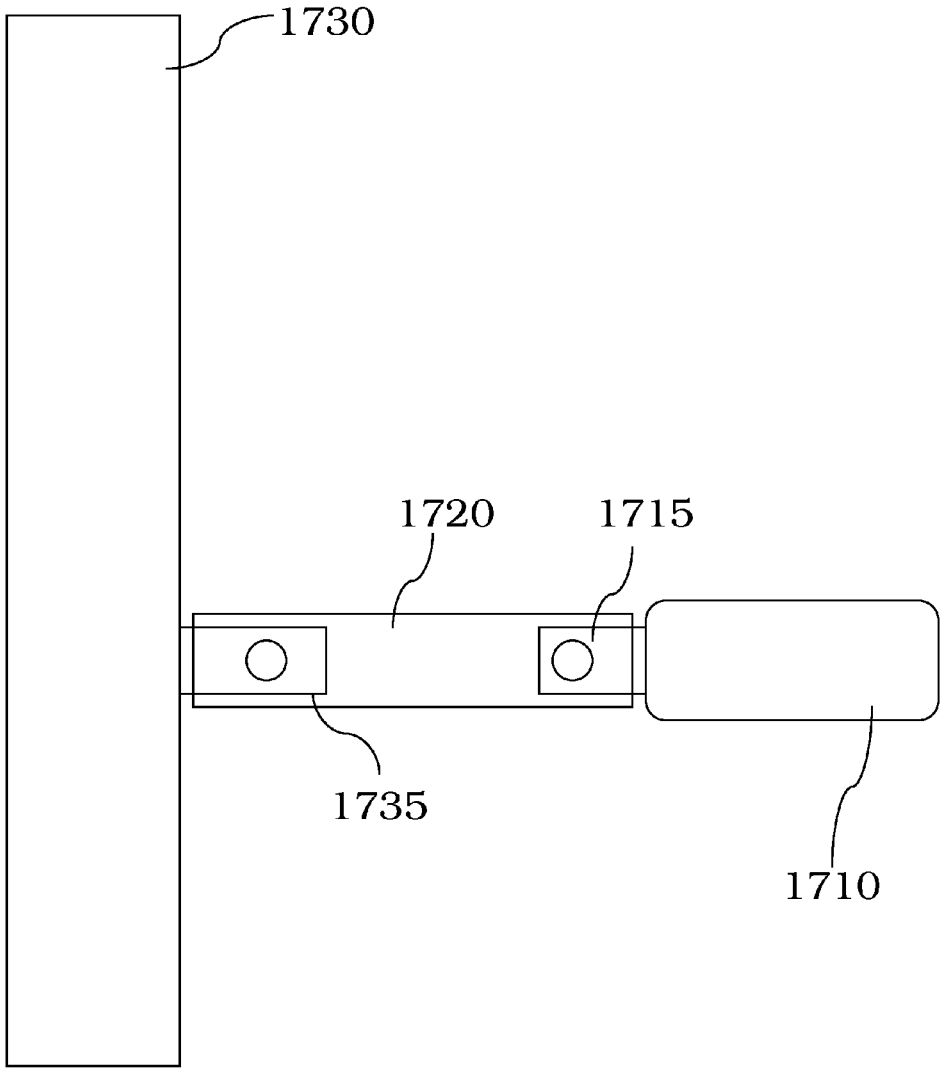

In certain examples, a hub may be coupled to a coupling, which itself is coupled to a support member, through one or more locking hinges. One example is shown in FIG. 17A. The hub 1710 comprises a locking hinge 1715 that couples to one end of a coupling 1720. The other end of the coupling 1720 is coupled to a support member 1730 through a joint 1735. In some examples, the joint 1735 is present on the outer sleeve of the support member 1730 such that movement of the telescopic inner sleeve does not alter the position of the hub 1710 when the chair frame is in use. The joint 1735 may lock or may not lock depending on the desired configuration. In addition, the joint 1735 may include one or more slots or protrusions to prevent the coupling 1720 from extending beyond a desired angle relative to the support member. When the chair frame is in an open position for use (FIG. 17B), the coupling 1720 is locked into place using the locking hinge 1715. The hub 1710 is then locked into place and prohibits the chair frame from being collapsed. To unlock the hub 1710, a release mechanism on either the hub 1710 itself or on the hinge 1715 can be activated to permit the coupling 1720 to be moved back to the position shown in FIG. 17A. In some examples, each of the support members of the chair frame can be coupled to a hub in a similar manner to that shown in FIGS. 17A and 17B. In addition, where two or more hubs are present, each may be configured with a locking mechanism similar or the same as the one described in reference to FIGS. 17A and 17B.

In other embodiments, the coupling can be rotated to lock the hub into place. For example, a coupling could be lowered to a position similar to that shown in FIG. 17B, and then the coupling could be rotated, e.g., by grasping the coupling and turning it clockwise or counterclockwise, to lock the coupling into position in the hub. The internal structure of the hub can include one or more slots or features that engage the coupling through a friction fit when the coupling is rotated in a first direction and release the coupling when the coupling is rotated in an opposite direction. A similar locking mechanism may also be present on the support member such that a single rotation of the coupling permits locking of the coupling to the hub and to the support member. Each of the couplings may be configured in a similar manner, or one or more of the couplings may be rotatably lockable, whereas one or more other couplings may lock to the hub through a hinge locking mechanism.

In embodiments where the coupling is rotated to lock the hub into place, the entire coupling may be rotated or the coupling may include a sleeve or other feature that can be rotated to lock the hub in place. For example, the coupling may include a sleeve that surrounds the coupling and can be inserted into the hub housing and rotated to lock the hub in place. In some examples, the coupling may also include a second sleeve that can interface with the support member to lock the end of the coupling at the support member in place. In other examples, the sleeve may not rotate but instead may be biased outward radially upon insertion into the hub such that the hub is locked into place. Inward radial pressure on the sleeve can release the sleeve from the hub to permit collapse of the chair frame. Additional features and configurations of couplings that comprise a sleeve will be readily selected by the person of ordinary skill in the art, given the benefit of this disclosure.

Figure 18:
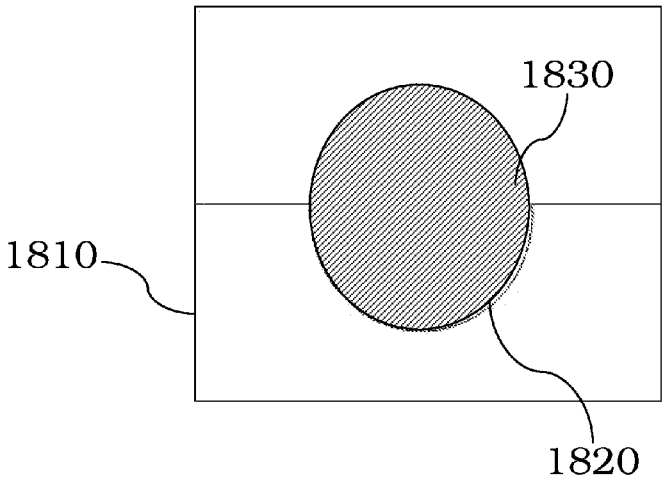
FIG. 18 is a side-view of a hub comprising a locking groove, in accordance with certain examples.

In some embodiments, the hub can include internal grooves configured to receive the couplings as the support members are placed into an extended position. A side view of one such groove is shown in FIG. 18. A hub 1810 comprises a groove 1820 that is configured to receive a coupling 1830 once the support member (not shown) to which the coupling is attached is moved into place. The groove 1820 engages the coupling 1830 through a friction fit and acts to retain the coupling 1830 through friction forces and forces exerted through the coupling 1820 by the support member. To unlock the hub 1810, the coupling can be lifted using upward force to remove the coupling 1830 from the groove 1820, and the chair frame can then be collapsed. Each of the couplings may be configured in a similar manner, or one or more of the couplings may be rotatably lockable or lock through a hinge locking mechanism, whereas one or more other couplings may lock using a hub groove and friction fit.

In certain examples, the hub may be configured with an open top such that a locking piece can be inserted into the hub to keep the couplings locked into place. The locking piece can take the form of, for example, a cross having grooves to engage each of the couplings of the chair frame. Upon insertion, the locking piece locks all the couplings in place to prevent the chair from collapsing during use.

In certain embodiments, the couplings between the hub and the support member can take various forms including, but not limited to, rods, rods with hinges, wires, removable telescopic arms or other support structures. In some examples, the coupling can be a rod whose overall length is fixed and whose position is adjusted through manipulation of the support members and/or hub. In other examples, the rod itself can be configured similar to the support members, e.g., with an inner sleeve, outer sleeve and a locking mechanism on the inner sleeve that is configured to engage the outer sleeve. The inner sleeve can be extended to adjust the overall length of the coupling to provide a wider footprint for the chair frame. In embodiments where the coupling is configured as a hinged rod, the hinge can be located medially, distally or proximate to the hub along the body of the coupling. The hinge can provide for further folding to reduce the overall footprint of the frame when in a closed position.

In an additional embodiment where the chair is configured with one or more wires that function as couplings between the hub and the support members, the hub can be actuated to a closed position such that the length of the wires between the hub and the telescopic member is fixed. For example, the hub can include a locking mechanism such that the downward pressure on the wire is effectuated to prohibit alteration of the wire length. In an alternative configuration, one or more locking pieces can be inserted into the hub to deter or prohibit lengthening of the wire to any substantial degree that might destabilize the chair frame.

In some examples, the hub can be produced using materials similar to those used to produce the support members, e.g., plastics, metals, or lightweight materials that can provide for locking of the couplings but are not so heavy that portability of the chair is compromised. In some examples, the hub can include one or more features that can function as a footrest. For example, the hub can include a folding platform configured to receive a user's feet when the chair is open and in use.

Figure 19:
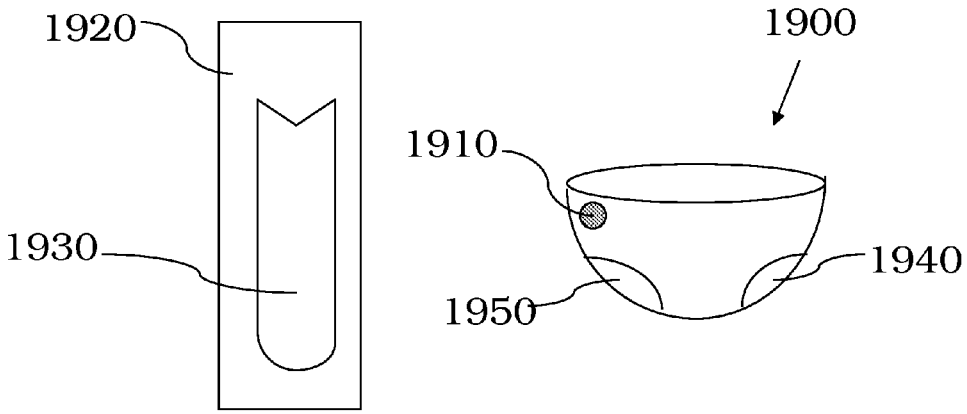
FIG. 19 is an illustration of a seat and a support member configured to receive the seat, in accordance with certain examples.

In certain embodiments, the seat portion of the chair interfaces to a proximate end of the support members, e.g., a seat end opposite to that where the feet of the telescopic member are optionally coupled. The exact configuration of the seat can vary, and in certain examples, the seat is designed to be easily inserted and removed by an end user. In some examples, the seat can be configured with a button that engages a lateral groove on the telescopic member. One such example is shown in FIG. 19. The seat 1900 comprises one or more protrusions or buttons 1910, e.g., the same number of buttons as support members, which can be slidingly engaged to a lateral groove 1930 on a support member 1920. The button 1910 can be inserted into the top of the lateral groove 1930 and then slid to the base of the lateral groove with gravity from the seated user acting to provide a downward force to keep the button 1910 in the lateral groove 1920. The seat can include, for example, leg openings 1940 and 1950 that permit placement of a subject into the seat by inserting their legs into the leg openings 1940 and 1950 once the seat is coupled to the various support members of the frame.

In other embodiments, the seat can include an inverted groove and the frame can include a button that engages the inverted groove of the seat to lock the seat into place. In yet other examples, the seat can include a button or feature that is placed through a vertical opening on the support member to fix the seat to the support members, e.g., the feature can be inserted into the vertical opening and then twisted to lock the seat to the chair frame. In additional examples, the seat may snap into guides on the support member to engage the seat through a friction fit. Upward force on the seat can be used to disengage the seat. Other mechanisms of coupling a seat to one or more of the chair frames described herein will be readily selected by the person of ordinary skill in the art, given the benefit of this disclosure.

In certain embodiments, the exact geometry and materials used to produce the seat can vary. In some examples, the seat is sized and arranged to receive a baby or toddler, e.g., a human weighing up to about 40-50 pounds. In other examples, the seat is sized and arranged to receive an adult. Where used with an adult, the seat may be placed on the adult prior to coupling to the support members to facilitate assembly of the seat to the frame and placement of the adult in the seat. The seat can be produced using washable fabrics that may optionally be reinforced with fibers, cords or other materials to increase the overall weight bearing capabilities of the seat. Suitable fabrics include, but are not limited to, woven fabrics, non-woven fabrics, cotton, polyester, denim, silk, linen, hemp, jute, wool or other desired fabrics. While not required, it is desirable that the fabric selected for use be machine washable. In some examples, a single size seat can be provided with slots or pockets configured to receive padding or other materials to reduce the overall size of the seat. In this manner, a single seat can be purchased and used as a baby or toddler's size increases. In other embodiments, the seat can be configured specifically for a certain weight or size and replacement seats can be purchased once the user outgrows a first seat. In additional embodiments, the seat may be configured with a substantially planar surface such that the chair frame and seat could be used as a bar stool, saw horse or in other applications.

In some embodiments, the seat may include its own frame, e.g., a seat frame, that provide structural support to the seat. For example, fabric can be draped between and wrapped around a generally concentric frame that provides support and that can couple to a tray as described in more detail below. In some examples, the concentric frame may be coupled to the support members through a friction coupling such that the concentric frame of the seat snaps into grooves or slots on the support members. To remove the seat, upward pressure can be applied to the concentric frame to disengage the concentric frame from each of the support members.

In additional embodiments, the seat can be configured to receive a tray or similar component to permit access of food or other devices by a seated user. For example, a tray can be engaged to the seat through friction fit couplers on the tray to facilitate feeding of a seated user. The tray can be produced from materials similar to those used to produce the support members, e.g., plastics, stainless steels, etc. In other examples, the tray can couple to one or more support members instead of the seat or in addition to the seat.

In certain embodiments, the seat and/or chair frame can include integral safety features, e.g., leg straps, a seat belt, a restraint, buckles or the like to deter standing in the seat. The seat can also include electronic chimes, bells or warnings in the event the seated user becomes unseated or weight on the seat is otherwise reduced for some reason. For example, one or more pressure sensors can be sewn into the fabric of the seat and coupled to a speaker than can sound an audible alarm if the user stands up or weight on the seat is otherwise reduced.

In certain embodiments using the chair, the frame is first set up by extending each of the telescopic ends of the support members a desired distance to provide a suitable overall height. The couplings between the hub and the support members are then extended to a closed position to lock the couplings in place and stabilize the chair frame. If desired, further height adjustment can be made by altering the length of the telescopic members. The seat couplings of the seat are then inserted into the seat end of each of the support members. A user, e.g., baby, toddler, geriatric person, etc., can then be placed in the seat, or the seat can be added to the user prior to coupling the seat to the support members. In taking down the chair, the reverse process can be performed. The seat can be removed from each of the seat ends of the seat, and then each of the couplings between the hub and the support member can be moved to an open position to draw the support members together inward toward the hub. In some examples, the support members are drawn together such that they are substantially the same distance from each other along their entire length. The telescopic ends of the support members can be moved to a fully closed position (or left extended or moved to any position between the fully closed and fully extended positions). In some examples, the length of each of the support members can be altered to be substantially the same during take down, whereas in other examples, one or more of the support members can have a longer length than the other support members once the chair is taken down.

In another embodiment where the chair is used, the seat couplings are first inserted into the seat end of each of the telescopic members. The frame is then set up by extending each of the telescopic ends of the support members a desired distance to provide a suitable overall height. The couplings between the hub and the support members are then extended to a closed position to lock the couplings in place and stabilize the chair frame. If desired, further height adjustment can be made by altering the length of the telescopic members. A user, e.g., baby, toddler, geriatric person, etc., can then be placed in the seat, or the seat can be added to the user prior to coupling the seat to the support members. In taking down the chair, the reverse process can be performed. Each of the couplings between the hub and the support member can be moved to an open position to draw the support members together inward toward the hub. In some examples, the support members are drawn together such that they are substantially the same distance from each other along their entire length. The telescopic ends of the support members can be moved to a fully closed position (or left extended or moved to any position between the fully closed and fully extended positions). In some examples, the length of each of the support members can be altered to be substantially the same during take down, whereas in other examples, one or more of the support members can have a longer length that then other support members once the chair is taken down. The seat can then be removed, if desired, or may remain in place during storage of the chair.

In an additional embodiment where the hub is configured as a locking hub and the couplings are each wires, the chair can be set up by extending each of the telescopic ends of the support members a desired distance to provide a suitable overall height. The length of the wire couplings between the hub and the support members are then selected and the hub is depressed to lock the wires into place and stabilize the chair frame. If desired, further height adjustment can be made by altering the length of the telescopic members. The seat couplings of the seat are then inserted into the seat end of each of the support members. A user, e.g., baby, toddler, geriatric person, etc. can then be placed in the seat, or the seat can be added to the user prior to coupling the seat to the support members. In taking down the chair, the reverse process can be performed. The seat can be removed from each of the seat ends of the seat, and then the hub can be unlocked such that the length of the wires can be altered and the support members can be drawn together inward toward the hub. In some examples, the support members are drawn together such that they are substantially the same distance from each other along their entire length. The telescopic ends of the support members can be moved to a fully closed position (or left extended or moved to any position between the fully closed and fully extended positions). In some examples, the length of each of the support members can be altered to be substantially the same during take down, whereas in other examples, one or more of the support members can have a longer length that then other support members once the chair is taken down.

In another embodiment where a chair with wire couplings is used, the seat couplings are first inserted into the seat end of each of the telescopic members. The frame is then set up by extending each of the telescopic ends of the support members a desired distance to provide a suitable overall height. The length of the wire couplings between the hub and the support members are then selected and the hub is depressed to lock the wires into place and stabilize the chair frame. If desired, further height adjustment can be made by altering the length of the telescopic members. A user, e.g., baby, toddler, geriatric person, etc., can then be placed in the seat, or the seat can be added to the user prior to coupling the seat to the support members. In taking down the chair, the reverse process can be performed. The hub can be unlocked and the length of the wire couplings between the hub and the support members can be altered to draw the support members together inward toward the hub. In some examples, the support members are drawn together such that they are substantially the same distance from each other along their entire length. The telescopic ends of the support members can be moved to a fully closed position (or left extended or moved to any position between the fully closed and fully extended positions). In some examples, the length of each of the support members can be altered to be substantially the same during take down, whereas in other examples, one or more of the support members can have a longer length that then other support members once the chair is taken down. The seat can then be removed, if desired, or may remain in place during storage of the chair.

In certain embodiments, a method of facilitating placement of a human subject, e.g., a human toddler or non-toddler human, is disclosed. The method comprises providing at least one of the chairs, devices or chair frames described herein. In other embodiments, the method can comprise providing instructions to open and close the chair.

In other embodiments, a method of facilitating feeding of a human subject, e.g., a human toddler or non-toddler human, is disclosed. The method comprises providing at least one of the chairs, devices or chair frames described herein. In other embodiments, the method can comprise providing instructions to open and close the chair.

The chairs described herein may include additional features to facilitate portability, e.g., locking wheels on one or more dorsal surfaces of one or more back support members such that tilting provides for engagement of the wheels with the ground to permit rolling or movement of the chair. In certain embodiments, the chairs described herein lack any hinges, e.g., are hingeless, to reduce the likelihood of pinching or crushing. While hinges may be included in certain configurations, in other configurations it may be desirable to omit hinges to facilitate easy set-up and take down.

Certain specific examples are described below to illustrate further the novel embodiments and features described herein.

Example 1

Figure 20A:
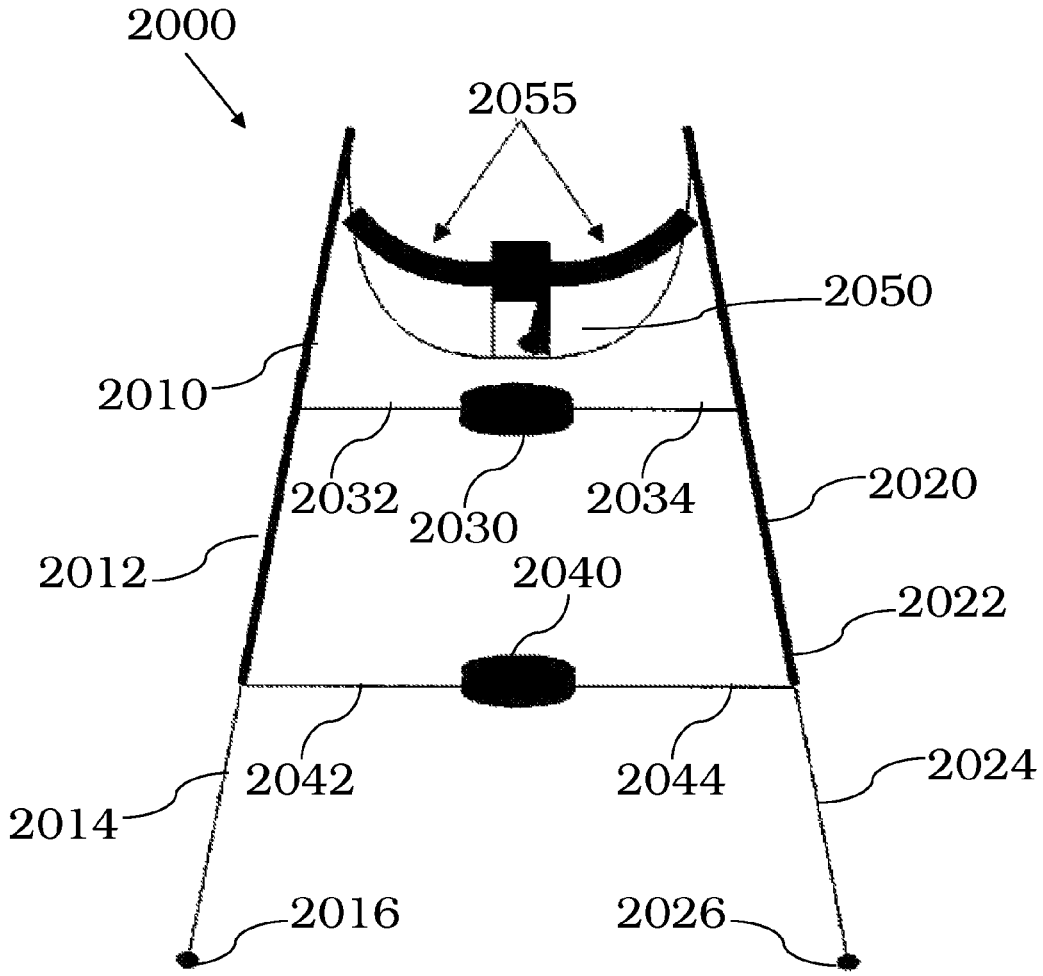
FIGS. 20A-20C are illustrations showing an embodiment of a chair, in accordance with certain examples.
Figure 20B:
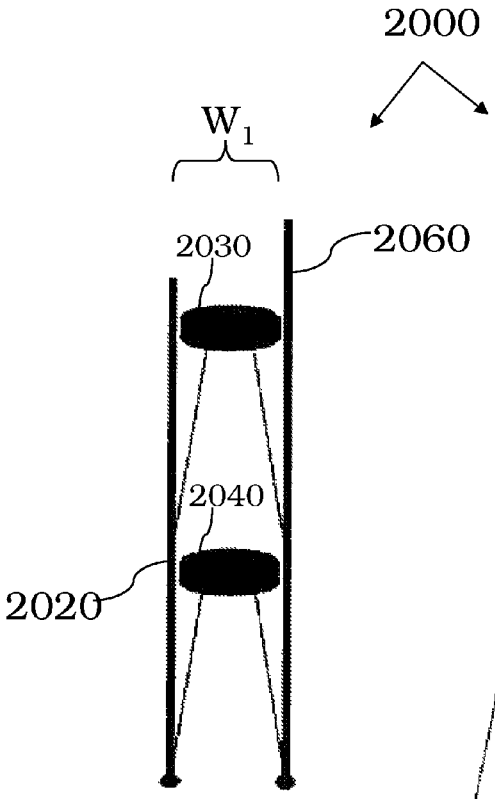
Figure 20C:
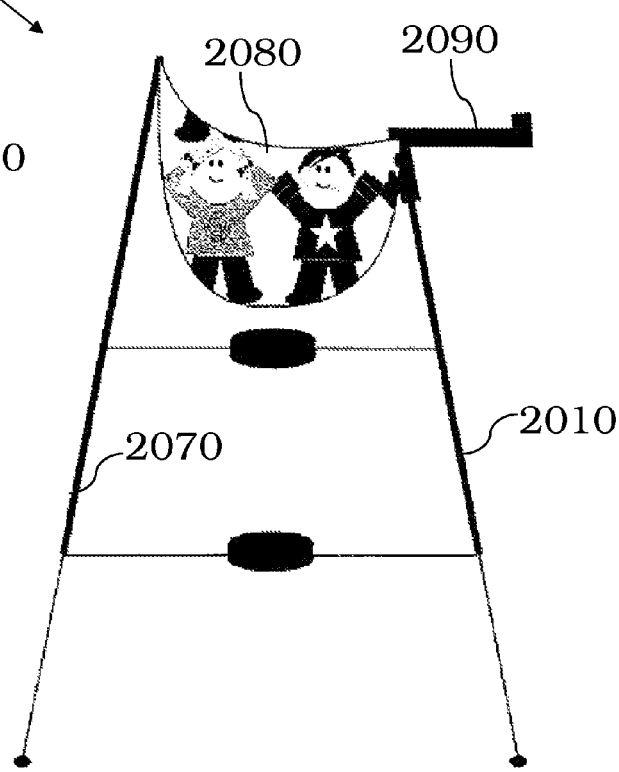

Referring to FIG. 20A, a front view of a chair 2000 comprising a first support member 2010, a second support member 2020, a first hub 2030 coupled to the first support member 2010 and the second support member 2020 through couplings 2032 and 2034, respectively, and a second hub 2040 coupled to the first support member 2010 and the second support member 2020 through couplings 2042 and 2044, respectively. The chair 2000 further comprises a seat 2050 coupled to the first support member 2010 and the second support member 2020. The seat 2050 comprises a restraint and buckle 2055. The first support member 2010 comprises an outer sleeve 2012 and an inner sleeve 2014 comprising a foot 2016. The second support member 2020 comprises an outer sleeve 2022 and an inner sleeve 2024 comprising a foot 2026. Referring now to the side view of the folded chair frame in FIG. 20B, a third support member 2060 is shown. The overall length of the third support member 2060 is larger than that of the second support member 2020, e.g., the third support member is about 20 inches to about 30 inches in total length, for example about 24 inches total length. When in a collapsed form the overall width $W_1$ of the chair frame is about 3 inches to about 7 inches, e.g., about 5 inches. Referring to FIG. 20C, the chair 200 further includes a fourth support member 2070, a seat 2080 and a removable tray 2090. The chair can be opened and closed using any one or more of the methods described herein.

Example 2

Figure 21A:
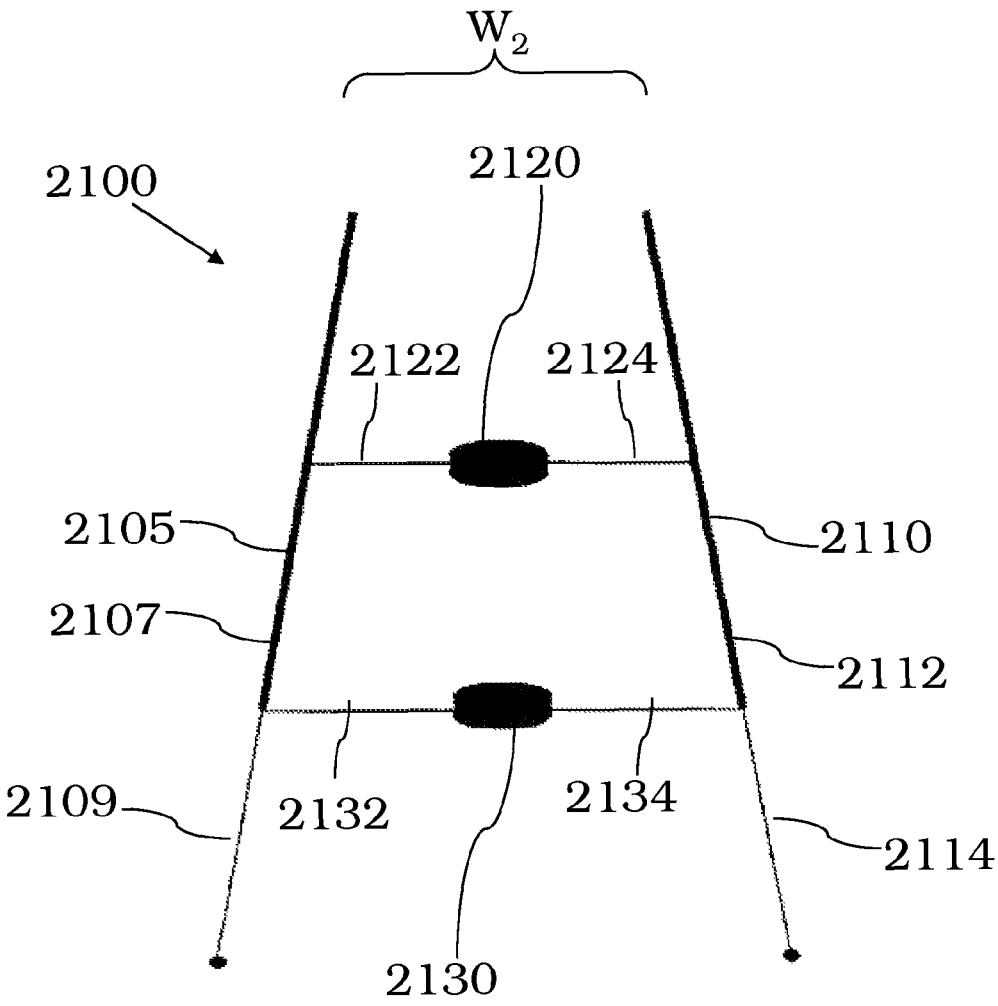
FIGS. 21A-21C are illustrations showing another embodiment of a chair, in accordance with certain examples.
Figure 21B:
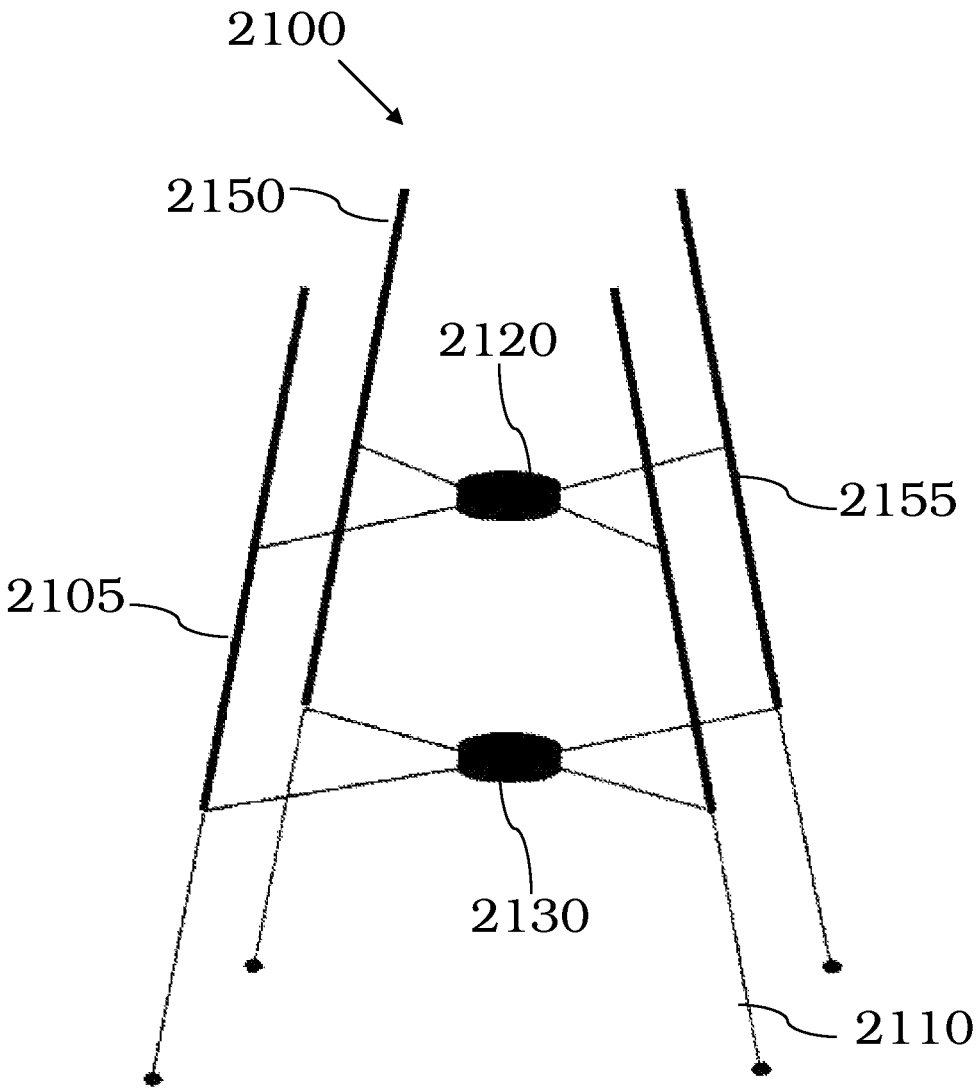
Figure 21C:
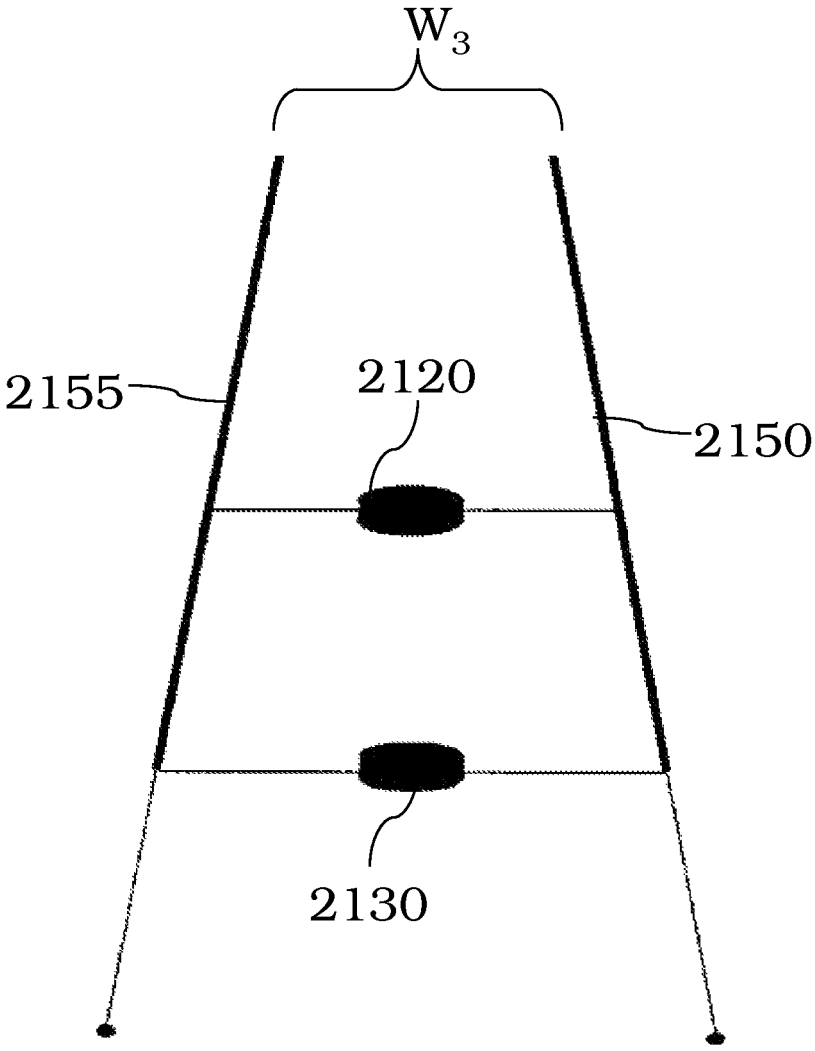

Referring to FIGS. 21A-21C, am chair having angled support members when in an open position is shown. Referring to the front view shown in FIG. 21A, the chair 2100 comprises a first support member 2110 comprising an outer sleeve 2117 and an inner sleeve 2109. The chair 2100 also comprises a second support member 2110 comprising an outer sleeve 2112 and an inner sleeve 2114. A first hub 2120 is coupled to the first support member 2105 and the second support member 2110 through couplings 2122 and 2124, respectively. A second hub 2130 is coupled to the first support member 2105 and the second support member 2110 through couplings 2132 and 2134, respectively. The chair 2100 in an open position comprises a width at the seat end of the support members 2105 and 2110 of about 8 inches to about 20 inches, e.g., about 20 inches. The overall height of the first support member 2105 and the second support member 2110 may be the same of may be different, e.g., each support member may be about 24 inches to about 36 inches in height such as, for example, about 30 inches in height. Referring to the angled view shown in FIG. 21B, the chair 2100 also comprises a third support member 2150 and a fourth support member 2155 each coupled to the first hub 2120 and the second hub 2130 through separate couplings. Referring to the back view shown in FIG. 21C, the overall width $W_3$ between the seat ends of the third support member 2150 and the fourth support member 2155 can be about 6 inches to about 14 inches, for example, about 10 inches. The overall height of the third support member 2150 and the fourth support member 2155 may be the same of may be different, e.g., each support member may be about 28 inches to about 40 inches in height such as, for example, about 34 inches in height. The chair can be opened and closed using any one or more of the methods described herein.

When introducing elements of the examples disclosed herein, the articles "a," "an," "the" and "said" are intended to mean that there are one or more of the elements. The terms "comprising," "including" and "having" are intended to be open-ended and mean that there may be additional elements other than the listed elements. It will be recognized by the person of ordinary skill in the art, given the benefit of this disclosure, that various components of the examples can be interchanged or substituted with various components in other examples.

Although certain aspects, examples and embodiments have been described above, it will be recognized by the person of ordinary skill in the art, given the benefit of this disclosure, that additions, substitutions, modifications, and alterations of the disclosed illustrative aspects, examples and embodiments are possible.

What is claimed is:

1. A chair frame comprising:

first, second, third and fourth support members each comprising a seat end and a telescopic end, the telescopic end configured to alter the length of the support members, in which the first, second, third and fourth support members together are configured to maintain the seat in an upright position when the telescopic end of each of the first, second, third and fourth members are extended;

a hub coupled to the first support member through a first coupling, the hub coupled to the second support member through a second coupling, the hub coupled to the third support member through a third coupling, and the hub coupled to the fourth support member through a fourth coupling, in which the hub is coupled to each of the first, second, third and fourth support members through a respective rod between the hub and each of the first, second, third and fourth support members; and an additional hub coupled to the first support member through a fifth coupling, the additional hub coupled to the second support member through a sixth coupling, the additional hub coupled to the third support member through a seventh coupling, and the additional hub coupled to the fourth support member through an eighth coupling, in which the additional hub is coupled to each of the first, second, third and fourth support members through an additional respective rod between the additional hub and each of the first, second, third and fourth support members, in which the hub and the additional hub are separate and not coupled to each other.

2. The chair frame of claim 1, in which the telescopic end of the first support member comprises an inner sleeve and an outer sleeve, the inner sleeve configured to engage the outer sleeve to lock the inner sleeve and the outer sleeve.

3. The chair frame of claim 1, in which the telescopic end of each of the first, second, third and fourth support members comprises an inner sleeve and an outer sleeve, the inner sleeve configured to engage the outer sleeve to lock the inner sleeve and the outer sleeve.

4. The chair frame of claim 1, in which the seat end of each of the first, second, third and fourth support members comprises a slot configured to engage and retain a seat.

5. The chair frame of claim 1, in which at least one of the telescopic members comprises a wheel to facilitate movement of the chair frame.

6. The chair frame of claim 1, in which the first, second, third and fourth couplings are each a rod.

7. The chair frame of claim 1, in which the first, second, third and fourth support members are each configured at an acute angle relative to a surface in which the telescopic end rests against.

8. The chair frame of claim 1, in which the additional hub and the hub are arranged in a stacked configuration.

9. A chair comprising:

a seat;

a first support member comprising a telescopic end and a seat end, the seat end comprising coupling means for engaging the seat to the seat end of the first support member, and the telescopic end comprising an inner sleeve and an outer sleeve, in which the inner sleeve is configured to engage the outer sleeve to lock the inner sleeve to the outer sleeve, the inner sleeve further comprising a release mechanism to release the inner sleeve from the outer sleeve;

a hub coupled to the first support member through a first coupling;

a second support member coupled to the hub through a second coupling, the second support member comprising a telescopic end and a seat end, the seat end comprising coupling means for engaging the seat to the seat end of the second support member, and the telescopic end comprising an inner sleeve and an outer sleeve, in which the inner sleeve is configured to engage the outer sleeve to lock the inner sleeve to the outer sleeve, the inner sleeve further comprising a release mechanism to release the inner sleeve from the outer sleeve;

a third support member coupled to the hub through a third coupling, the third support member comprising a telescopic end and a seat end, the seat end comprising coupling means for engaging the seat to the seat end of the third support member, and the telescopic end comprising an inner sleeve and an outer sleeve, in which the inner sleeve is configured to engage the outer sleeve to lock the inner sleeve to the outer sleeve, the inner sleeve further comprising a release mechanism to release the inner sleeve from the outer sleeve;

a fourth support member coupled to the hub through a fourth coupling, the fourth support member comprising a telescopic end and a seat end, the seat end comprising coupling means for engaging the seat to the seat end of the fourth support member, and the telescopic end comprising an inner sleeve and an outer sleeve, in which the inner sleeve is configured to engage the outer sleeve to lock the inner sleeve to the outer sleeve, the inner sleeve further comprising a release mechanisms to release the inner sleeve from the outer sleeve, in which the hub is coupled to the first support member through a rod between the first coupling and the hub, in which the hub is coupled to the second support member through a rod between the second coupling and the hub, in which the hub is coupled to the third support member through a rod between the third coupling and the hub, in which the hub is coupled to the fourth support member through a rod between the fourth coupling and the hub;

an additional hub coupled to the first support member through a fifth coupling, the additional hub coupled to the second support member through a sixth coupling, the additional hub coupled to the third support member through a seventh coupling, and the additional hub coupled to the fourth support member through an eighth coupling, in which the additional hub is coupled to the first support member through a rod between the fifth coupling and the additional hub, in which the additional hub is coupled to the second support member through a rod between the sixth coupling and the additional hub, in which the additional hub is coupled to the third support member through a rod between the seventh coupling and the additional hub, in which the additional hub is coupled to the fourth support member through a rod between the eighth coupling and the additional hub, and in which the hub and the additional hub are separate and not coupled to each other.

10. The chair of claim 9, in which the seat is sized and arranged to receive a toddler.

11. The chair of claim 9, in which the seat is sized and arranged to receive a non-toddler.

12. The chair of claim 9, in which the first, second, third and fourth couplings are each configured as a rod.

13. The chair of claim 9, in which the first, second, third and fourth couplings are attached to their respective support member through a hinge.

14. The chair of claim 9, further comprising a tray coupled to the chair frame.

15. The chair of claim 9, in which the additional hub and the hub are arranged in a stacked configuration.

* * * * *